US005203550A

United States Patent [19]

Kawano et al.

[11] Patent Number: 5,203,550

[45] Date of Patent: Apr. 20, 1993

[54] SORTER WITH ROTATABLE TRAYS SUPPORTED ON GUIDE MEMBERS

[75] Inventors: Minoru Kawano; Kazunobu Miura; Kohji Yoshie, all of Hachioji, Japan

[73] Assignee: Konica Corporation, Tokyo, Japan

[21] Appl. No.: 815,923

[22] Filed: Dec. 30, 1991

[30] Foreign Application Priority Data

Jan. 8, 1991 [JP] Japan ..... 3-000658
Feb. 26, 1991 [JP] Japan ..... 3-031034
Apr. 10, 1991 [JP] Japan ..... 3-077764

[51] Int. Cl.[5] ..... B42B 2/00; B65H 39/02
[52] U.S. Cl. ..... 270/53; 270/58
[58] Field of Search ..... 270/53, 37, 54, 58; 271/292, 213

[56] References Cited

U.S. PATENT DOCUMENTS 4,376,529 3/1983 George et al. ..... 270/53
4,382,592 5/1983 Harding et al. ..... 270/53
4,711,444 12/1987 Geurts ..... 271/292 X
4,762,312 8/1988 Ushirogata .
5,013,021 5/1991 Johdai et al. ..... 270/53

FOREIGN PATENT DOCUMENTS 62-244869 10/1987 Japan .
64-43457 2/1989 Japan .

*Primary Examiner*—Edward K. Look
*Assistant Examiner*—John Ryznic
*Attorney, Agent, or Firm*—Frishauf, Holtz, Goodman & Woodward

[57] ABSTRACT

The invention provides a sorting apparatus equipped with a stapler in which a plurality of plate-shaped bins for stacking sheets thereon are attached in tandem at regular intervals to a fixed shaft so that each of said bins rotates around the shaft between a sorting position to stack sheets and a stapling position to provide the stacked sheet to the stapler.

25 Claims, 25 Drawing Sheets

SORTER WITH ROTATABLE TRAYS SUPPORTED ON GUIDE MEMBERS

BACKGROUND OF THE INVENTION

The present invention relates to a sorter which is provided to an image forming apparatus such as a copier and printer to sort sheets discharged from the apparatus, and more particularly relates to a sorter having a plurality of bins, and the sorter is provided with a stapling device to staple the sheets in the bin.

For a sheet processing device provided with a stapling device to staple sheets discharged from a copier, printer and the like, a sheet finisher has been utilized which is installed together with an automatic recirculating document handler in order to staple the sheets. However, the aforementioned sheet finisher is disadvantageous because the structure is so complicated and expensive.

(1) In Japanese Patent Publication Open to Public Inspection no. 43457/1989, there has been disclosed an apparatus in which a stapling device is provided to a relatively simple bin-moving type of sorter. In the aforementioned apparatus, a stapling device to staple sheets discharged into a bin can be freely moved with regard to the bin.

(2) Another sorter is composed in such a manner that: a fixed type of stapling device is provided to each bin; and the bin is moved to the stapling position so that a bundle of sheets can be stapled.

(3) A sorter disclosed in the official gazette of Japanese Patent Publication Open to Public Inspection No. 244869/1987, includes: a bin having sheets is moved to a position where a stapling operation can be conducted; the sheets are stapled by a stapling device; and when the sheets in other bins are stapled, the stapling device is moved in a vertical direction.

In the aforementioned sorter of case (1) having a stapling device which can be moved freely, the moving stroke of the stapling device changes according to sheet size. Accordingly, when the vertical spacing of each bin is wide, the sorter size becomes large as a whole, and when the vertical spacing of a bin into which the stapling device is inserted, is extended, the mechanism becomes complicated. Further, this sorter is composed in such a manner that: a closed loop type of large slotted hole is formed in the bin; and a common alignment member is inserted into the aforementioned slotted hole so that the alignment member can be reciprocated. In this case, however, it takes time to assemble, overhaul and adjust the sorter because it is necessary to insert the aforementioned alignment member into the slotted hole after a plurality of bins have been assembled and further it is necessary to connect the alignment member with the upper and lower arms. Furthermore, in the case of a sorter in which sheets of different sizes are stacked in a bin as the center of the sheet agrees with the center of the bin, in which the bin is moved to a stapling position, the aforementioned slotted hole must be made large, so that this type of sorter is disadvantageous in that the size of the bin is extended.

In the aforementioned sorter of case (2), the structure of the sorter is complicated as a whole, and in the case where the vertical spacing of the bin is small, a special stapling device is required.

In the aforementioned sorter of case (3), each bin in which sheets are put, is moved straight along a bin guide at an appropriate time. Accordingly, it is disadvantageous in that the structure becomes complicated.

SUMMARY OF THE INVENTION

It is a primary object of the present invention to provide a sorter having a simple stapler device, having a reliable working. The sorter having a stapler according to the present invention, provided with a plurality of bins which receive and sort the sheets conveyed from an image forming apparatus, and provided with a stapler which staples the sheets stacked in the aforementioned bins, comprises: a fixed shaft vertically provided in the sorter body; a plurality of holding members which are mounted onto the fixed shaft at regular intervals; and a plurality of bins which are supported in such a manner that the plurality of bins are inclined with regard to the fixed shaft and the aforementioned holding members, and which can be rotated to a stapling position keeping them inclined condition.

In the sorter having a stapler according to the present invention, the aforementioned holding members are detachably inserted into U-shaped slots provided at one end of the aforementioned bins, and positioned with a closing member not to be loosened.

Further, in the sorter having a stapler according to the present invention, the aforementioned holding members are integrally formed and longitudinally arranged along the aforementioned fixed shaft, and are locked so as not to be rotated.

DESCRIPTION OF THE PREFERRED EMBODIMENTS

With reference to the drawings, an embodiment of the present invention will be explained as follows.

Figure 1:
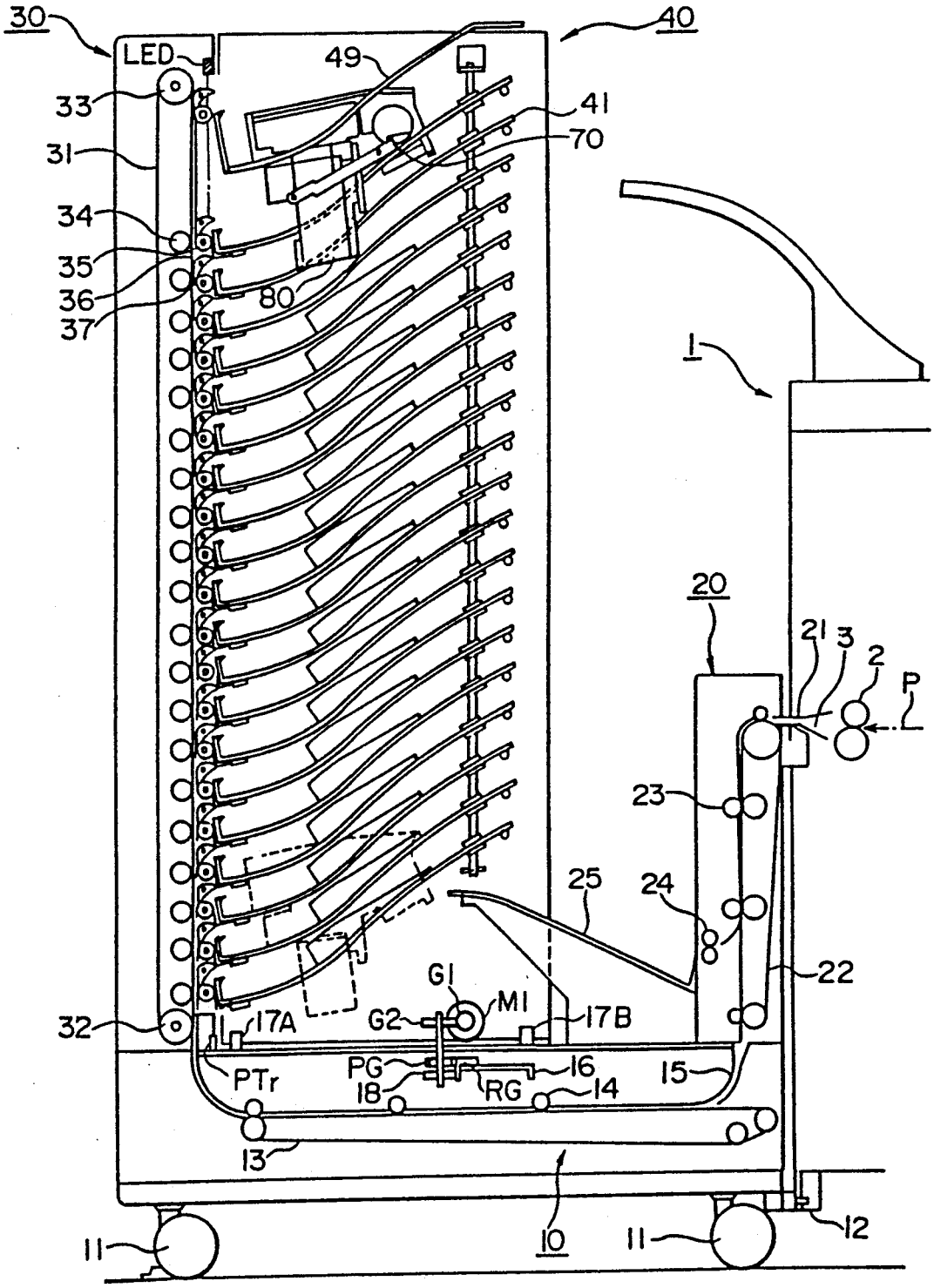
FIG. 1 is a view showing the structure of a sorter connected with the image forming apparatus body.

FIG. 1 is a view showing the structure of a sorter which is connected with a main body 1 of an image forming apparatus (for example, a copier). The sorter of the present invention comprises a base frame 10, downward conveyance section 20, upward conveyance section 30, and bin shift section 40.

The base frame 10 includes casters 11, connecting means 12 to connect the base frame 10 with an image forming unit, conveyance belt 13, idle rollers 14, guide plates 15, and drive means (not shown in the drawing).

A stay member 16 is fixed to the base frame (the horizontal conveyance section) 10 in a direction perpendicular to the surface of FIG. 1. A rack gear RG is fixed to the upper side of the stay member 16.

Rollers 17A, 17B for moving the frame are pivotally provided in the frame of bin moving section 40 which will be described later. The rollers 17A, 17B move along a rail (not shown) of the aforementioned base frame 10, so that the frame of the bin moving section 40 can be moved in a direction perpendicular to the surface of the drawing.

A drive motor M1 is provided in the frame of the aforementioned bin moving section 40 so that a pinion gear PG can be driven through gears G1 and G2. Since pinion gear PG is engaged with rack gear RG fixed to the aforementioned stay member 16, the frame of the bin moving section 40 is moved in a direction perpendicular to the surface of the drawing when motor Ml is rotated. Numeral 18 is a roller provided coaxially with the aforementioned pinion gear PG, wherein the roller 18 can be rotated freely.

The downward conveyance section 20 is connected with paper discharging rollers 2 and a discharging port 3 of the image forming apparatus 1. The downward conveyance section 20 is composed of a guide plate 21 to receive a discharged sheet P so that it can be conveyed downward, a conveyance belt 22 and idle rollers 23 to convey sheet P to the conveyance belt 13 in the aforementioned base frame 10, and the like. Another conveyance means 24 and tray 25 are branched from the conveyance passage, which are utilized for discharging a preceding sheet in the image forming apparatus 1 when a jam has occurred in the ADF or the sorter. The upper portion of the frame corresponding to the aforementioned downward conveyance section 20 is freely opened and closed so that a jammed paper in the downward conveyance section 20 can be removed.

In the upper conveyance section 30, several endless conveyance belts 31 are provided between pulleys 32 and 33 which are rotatably mounted on the upper and lower portion of the support frame. A plurality of rollers 34 corresponding to the insert ports of the bins are provided inside the conveyance belt 31 in such a manner that the rollers 34 are rotatably contacted with the conveyance belt 31. A plurality of conveyance rollers 35 are provided outside the conveyance belt 31 correspondingly to the rollers 34 in such a manner that the conveyance rollers 35 are rotatably contacted with the conveyance belt 31.

Branch guides 36 are disposed between the conveyance rollers 35 at the entrances of the bins. These branch guides 36 are rotatably supported by shafts 37 which are provided to the aforementioned support frame, and switched by levers and solenoids provided at the ends of the shafts 37, wherein the levers and solenoids are not illustrated in the drawing. Accordingly, when a branch guide 36 is rotated clockwise, the lower edge claw portion of the branch guide 36 crosses the paper conveyance passage composed of the conveyance belt 31 and the conveyance rollers 35 so that the paper can not be conveyed upward. In this way, the branch guide 36 works for sending papers into the bin. When a paper P is conveyed under the aforementioned condition, the paper P is curved along the inner curved surface of the branch guide 36 in the direction of a right angle, and the paper P is received by bin 41.

Figure 2:
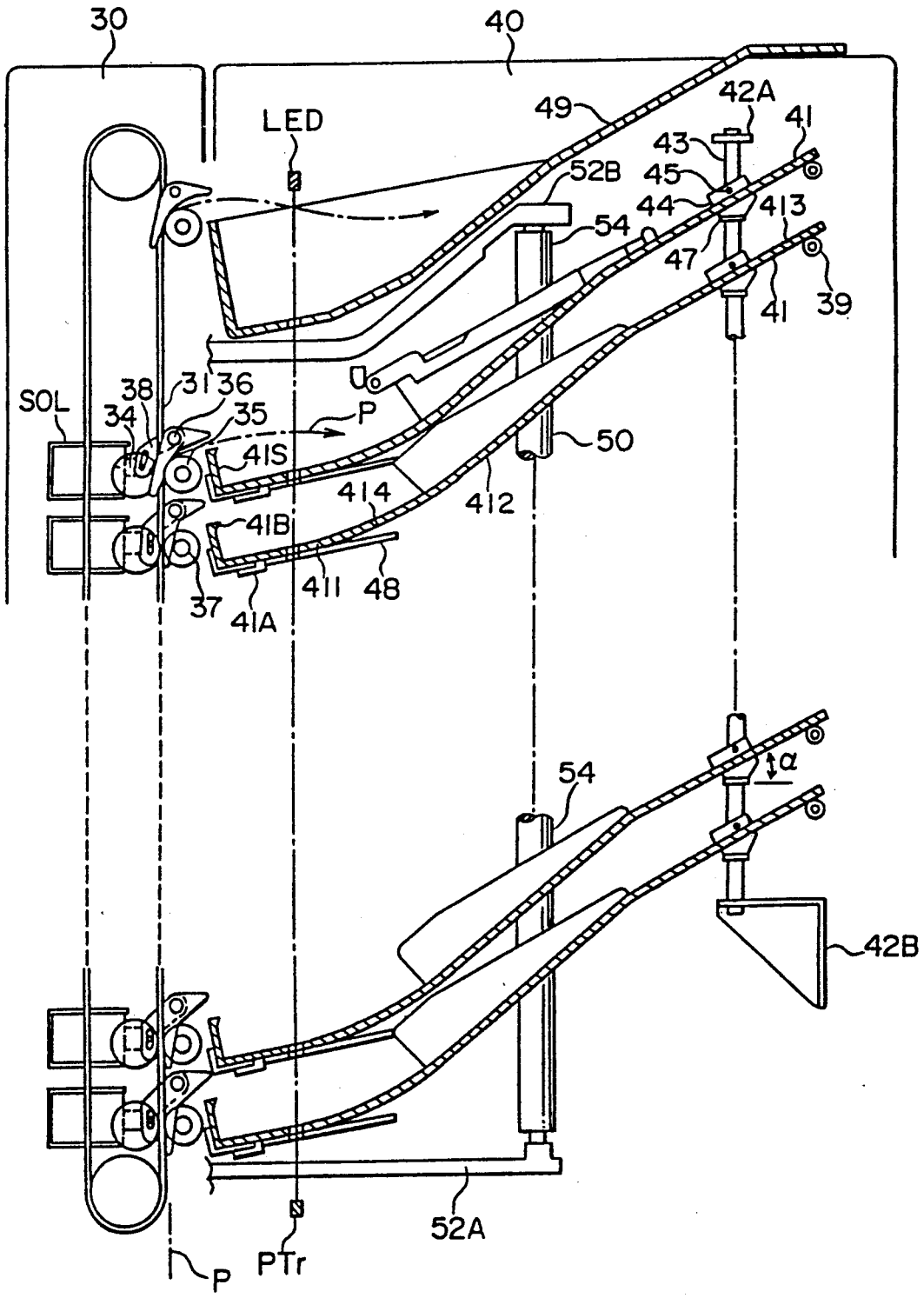
FIG. 2 is a partial sectional view showing the member composing the branch passage of papers, and the upper bin of the sorter.
Figure 3A:
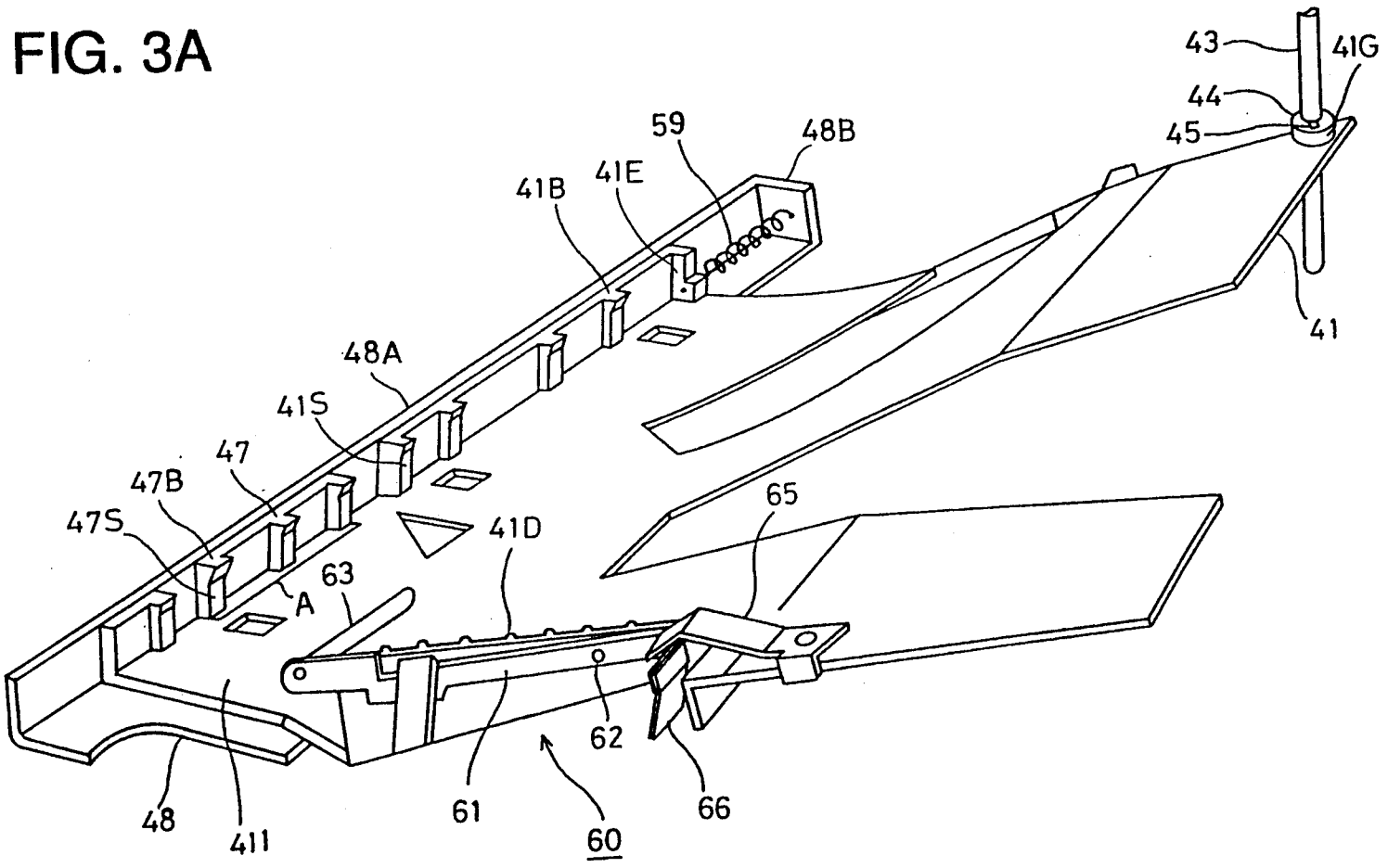
FIGS. 3A and 3B are perspective views of a bin.
Figure 3B:
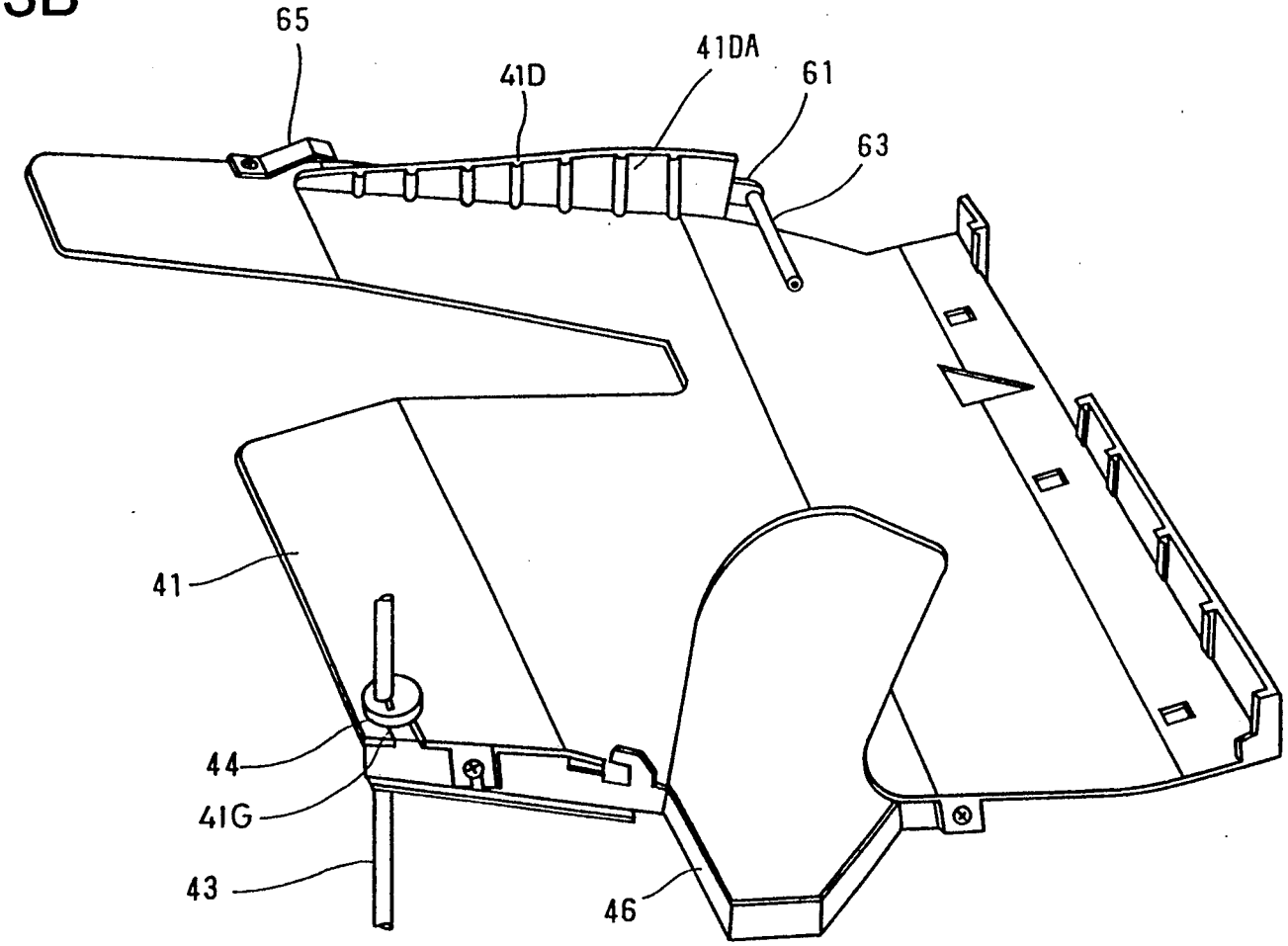
Figure 4:
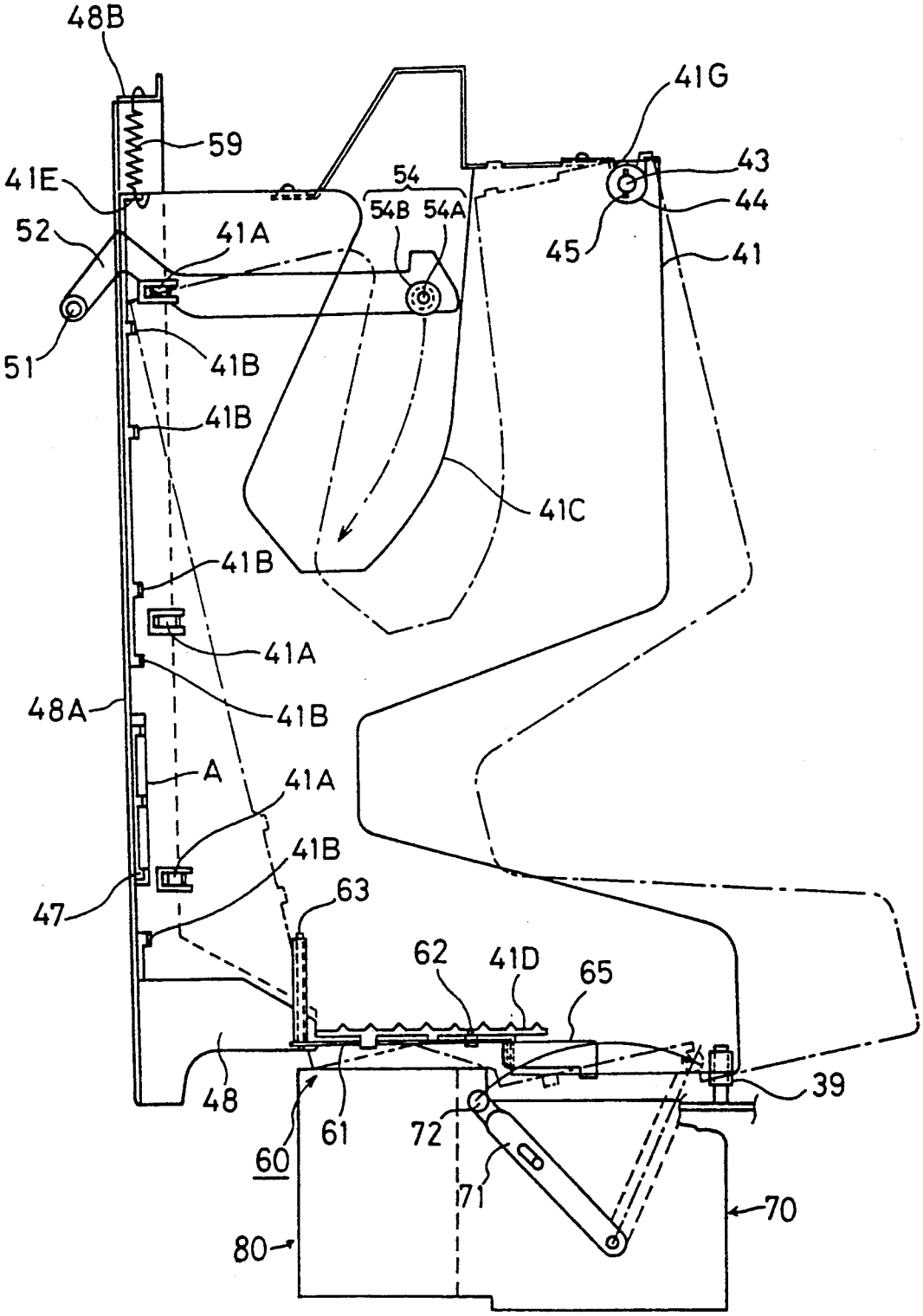
FIG. 4 is a plan view of the bin and relating members.

FIG. 2 is a partial sectional view of the composing members of the aforementioned branch conveyance passage and the bin. FIG. 3 and FIG. 4 show the bin 41 and related parts.

A plurality of bins (for example, 20 bins) are provided to the bin moving section 40 at regular intervals in such a manner that the bins can be turned in the horizontal direction. That is, the bottom portion (the left side of FIGS. 2, 3 and 4) of the bin 41 is slidably supported on a guide plate 48 fixed to the bin moving section 40.

A non-sort bin 49, which is deep, is provided uppermost of the aforementioned plurality of bins 41 (which are 20 bins in FIG. 1). The non-sort bin 49 is a bin in which image-recorded papers P not required to be sorted are accommodated, and about 100–300 papers can be stacked on the non-sort bin 49.

Numeral 41A in FIG. 2 shows three claws provided on the reverse side of the bin 41, wherein the claws are engaged with cut-out portions of the aforementioned guide plate 48. Numeral 41B shows five rear stoppers which are provided on the paper introducing side on the upper surface of the bin 41. The upper end of the vertical surface of the stopper is curved in such a manner that it forms a claw, so that papers P can be prevented from leaving the bin when the trailing ends of papers P are curled.

The sheet stacking surface of the bin 41 is composed of: a lower stacking surface 411 which is connected with a stopper wall 41S to align the trailing ends of sheets, and makes a gentle angle (for example, about 10°) with a horizontal surface; an intermediate stacking surface 412 which is connected with the lower stacking surface 411 through a curved surface 414, and makes a sharp angle (for example, about 40°) with the horizontal surface; and an upper stacking surface 413 which is connected with the intermediate stacking surface 412, and makes an angle of α (for example, about 30°) with the horizontal surface.

Stopper surface 41S located in the base portion of the bin 41 makes a right angle with the lower stacking surface 411 so that the alignment of a sheet bundle can be ensured when a stapling operation is conducted. When the stopper surface 41S is provided vertically and the lower stacking surface 411 makes a gentle angle with the horizontal surface, deformation of sheet edge can be prevented and alignment of sheets can be positively carried out when the sheets slide on the inclined surface.

Since the aforementioned intermediate stacking surface 412 is provided forming a sharp angle, paper P discharged onto the bin 41 can be positively slid downward on the surface by its weight, so that alignment can be positively conducted. Due to the foregoing, electrostatically charged sheets or curled sheets can be positively slid downward along the surface, and stopped right at the stopper surface 41S.

Since inclination angle α of the upper stacking surface 413 is set to be a little smaller than that of the intermediate surface 412, that is, α is set to about 30°, the distance between the bins 41 can be minimized and the total height of the sorter can be reduced. The upper stacking surface 413 is a surface on which sheets of a large size (for example, sheets of B4 size, or A3 size) are stacked, and these sheets are sufficiently heavy. Therefore, they are slid downward by their weight due to the inclination angle α and the sharp inclination angle (about 40°) of the intermediate stacking surface 412 so that the sheets can be aligned. The shape of non-sort bin 49 fixed to the sorter body at the uppermost portion of the bin 41, is approximately the same as that of the bin 41.

It is necessary to provide the plurality of stopper walls 41S which align the trailing ends of papers P in such a manner that papers of all sizes can be contacted with the left end portion of the bin 41. However, in the case of a sorter in which the bin 41 is turned for stapling while the distance between the bins 41 is maintained to be minimum, a problem is caused in which an upper end portion of the stopper wall 41S comes into contact or collides with a bottom portion of the upper bin 41.

In order to avoid the aforementioned interference and collision between the upper and lower bins, a portion of the vertical wall having five stopper walls 41S of the bin 41 is cut out so that the wall can not interfere with the lower bin 41.

On the other hand, an auxiliary reference plate 47 is fixed to a position on a vertical surface 48A of the aforementioned guide plate 48 on which the rear bottom surface of the bin 41 is loaded, correspondingly to cut out portion A of the bin 41. The aforementioned reference plate 47 is provided with three stopper walls 47S of the same shape in order to make up for the stopper wall 41S, a portion of which has been cut out. A curved claw 47B is protruded from an upper end portion of the vertical surface of the stopper wall 47S, and the shape of the claw 47B is the same as that of the aforementioned claw 41B.

Spring 59 is a tension coil spring stretched between an end portion 48B of a vertical surface 48A of the guide plate 48 fixed to the bin moving section 40 of the sorter body, and an end portion 41E of the bin 41. The spring 59 pulls the bin 41 in a bin turning process performed by a turning unit 70 described later, so that the bin 41 can be returned to its initial position, and the bin 41 comes into contact with the vertical surface 48A of the guide plate 48 with pressure. Under the condition that the bin 41 is pulled by the spring 59 and closely contacted with the vertical surface 48A of the guide plate 48, the stopper walls 41S and 47S are set on the same surface, and form a stopping surface with which the trailing ends of papers collide.

In this case, the shapes and heights of the claws 41B and 47B become the same. When the bin 41 is turned by the bin turning unit 70, a bundle of papers on the bin 41 are moved to a stapling position while the trailing ends of the papers are contacted with the stopper wall 41S. However, the stopper wall 47S provided on the auxiliary reference plate 47 fixed to the guide plate 48, is left in the fixed position. Consequently, when the upper bin 41 is turned, the lower stopper wall 47S does not interfere with the bottom of the upper bin 41.

Paper P which has been conveyed to the upward conveyance section 30 of the sorter at high speed, is conveyed in the upward conveyance section as follows:

Paper P is conveyed upward being pinched by the conveyance belt 31 and the conveyance rollers 35. Then, paper P is conveyed to the right direction by the action of a branch claw 36 which is switched clockwise by a solenoid action not shown in the drawing. Paper P passes through an upper opening of the claw 41B of the bin 41 and the claw 47B of the auxiliary reference plate 47, and then ascends upward passing between the curved surface 414 of the bin 41 and the rib 41R of the bottom of the upper bin, and between the inclined surface 412 and the aforementioned rib 41R. After the trailing end of paper P has passed through the contact point of the belt 31 and the roller 35, paper P is discharged at its conveyance speed. After the trailing end of paper P has passed through the upper portion of the stopper walls 41S and 47S, paper P which has been conveyed upward, goes downward by its own weight, and slides back on the inclined surfaces 413, 412, and 413. After that, the trailing end of paper P collides with the stopper walls 41S and 47S and stops. Successive paper P is conveyed into the bin 41 in the same manner, and slides back on previous paper P stacked on the bin 41, so that it can be aligned.

A sliding member (a holding member) 44 is engaged with a vertical fixed shaft 43 which is supported by supporting members 42A, 42B fixed to the frame of the bin moving section 40. The aforementioned sliding member 44 is positioned by a pin 45 and a calking member 47.

Figure 5:
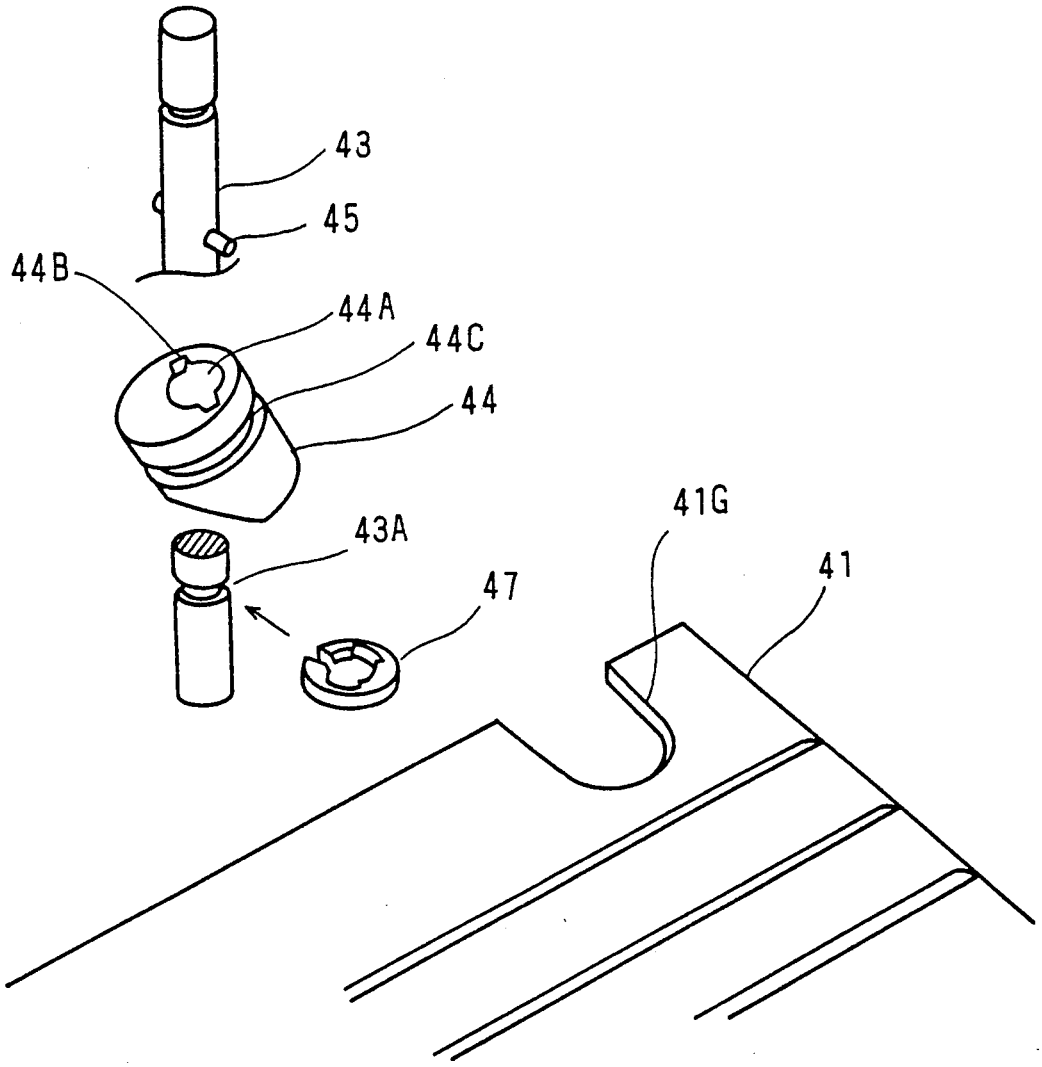
FIG. 5 is an exploded perspective view of the bin and the slide member.

FIG. 5 is an exploded perspective view of the bin 41 and the sliding member 44. The fixed shaft 43 is provided with holes for pins, the number of which is the same as that of the bins 41, and also provided with grooves 43A for the calking members (for example, E rings). The sliding member 44 is provided with a through hole 44A through which the aforementioned fixed shaft 43 penetrates, a groove 44B with which a pin 45 is engaged, and a neck portion 44C by which a U-shaped cut out 41G of the bin 41 can be attached and detached. The aforementioned neck portion 44C is inclined with regard to the through hole 44A (for example, $\alpha=30°$).

The sliding member 44 is made of a material having excellent less abrasion property, for example, resin such as polyacetal. Next, the assembly process of the bin 41 will be explained as follows.

(1) The fixed shaft 43 is inserted into the through holes 44A of the aforementioned plurality of sliding members 44.

(2) The pins 45 are successively inserted into the holes of the fixed shaft 43.

(3) Under the condition that the pin 45 is engaged with the groove 44A of the sliding member 44, the E ring is press-fitted into the groove 43A of the fixed shaft 43 located in the bottom portion of the sliding member 44, so that the sliding member 44 can be positioned in the axial direction of the fixed shaft 43, and locked by the pin 45 so as not to be rotated.

(4) The work of the aforementioned process (3) is conducted on all the sliding members 44 so that the sliding members can be positioned and assembled.

(5) Next, the fixed shaft 43 by which the sliding member 44 is positioned and supported, is assembled to the supporting members 42A, 42B, and fixed vertically.

(6) The U-shaped cut out 42G of each bin 41 is inserted to the neck portion 44C of the sliding member 44, and locked by a reinforcement member 46 fixed to a side of the bin, wherein the reinforcement member 46 will be explained later. (FIG. 3B)

(7) In the manner described above, the bin 41 can be freely turned around the sliding member 44. A rotatable connection between the neck portion 44C of the sliding member 44 and the U-shaped groove 41G of the bin 41, makes an angle of $\alpha$ (for example, 30°) with a horizontal surface, so that the each bin 41 is held in parallel each other being inclined by this angle.

The other side of the bin 41 is supported on a roller 39 which can be rotated freely being installed in a portion of the frame of the bin moving section 40. In the manner described above, the bin 41 is supported by the guide plate 48, the sliding member 44 and the roller 39, and can be freely rotated around the fixed shaft 43.

In the sorter provided with a stapler, in order to insert papers P stacked on the bin 41 into the stapler, all the bins are moved forward and backward in the perpendicular direction to the drawing surface by motor Ml together with the bin moving section 40 correspondingly with the size of papers P, and further each bin 41 is individually turned by the bin turning unit 70 around the fixed shaft 43 as is shown in FIG. 1.

On the other hand, an alignment unit 50 which aligns the side of paper P discharged onto the bin 41 from the image forming apparatus, is provided in a portion of the fixed frame of the upward conveyance section 30.

The alignment unit 50 is operated in such a manner that: an upper arm 52B and lower arm 52A which can be freely rotated being engaged with a vertical rotating shaft 51 rotated by pulse motor M2, support and oscillate an alignment rod 54. An upper end of a core 54A of the alignment rod 54 is held by an aligning bearing 53B provided at the tip portion of the upper arm 52B. A lower end of the core 54A of the alignment rod 54 is engaged with and held by an aligning bearing 53A provided at the tip of the lower arm 52A. The lower arm 52A is engaged with a journal 56A provided in the lower portion of the aforementioned frame, so that it can be rotated. In the same manner, the upper arm 52B is engaged with a journal 56B so that the upper arm 52B can be rotated. The alignment rod 54 is structured in such a manner that: the peripheral surface of the core 54A is coated with a resilient member 54B composed of a foam material such as sponge. Accordingly, the alignment rod 54 is contacted with the side edge of discharged paper P with pressure so that paper P can be aligned.

Figure 7:
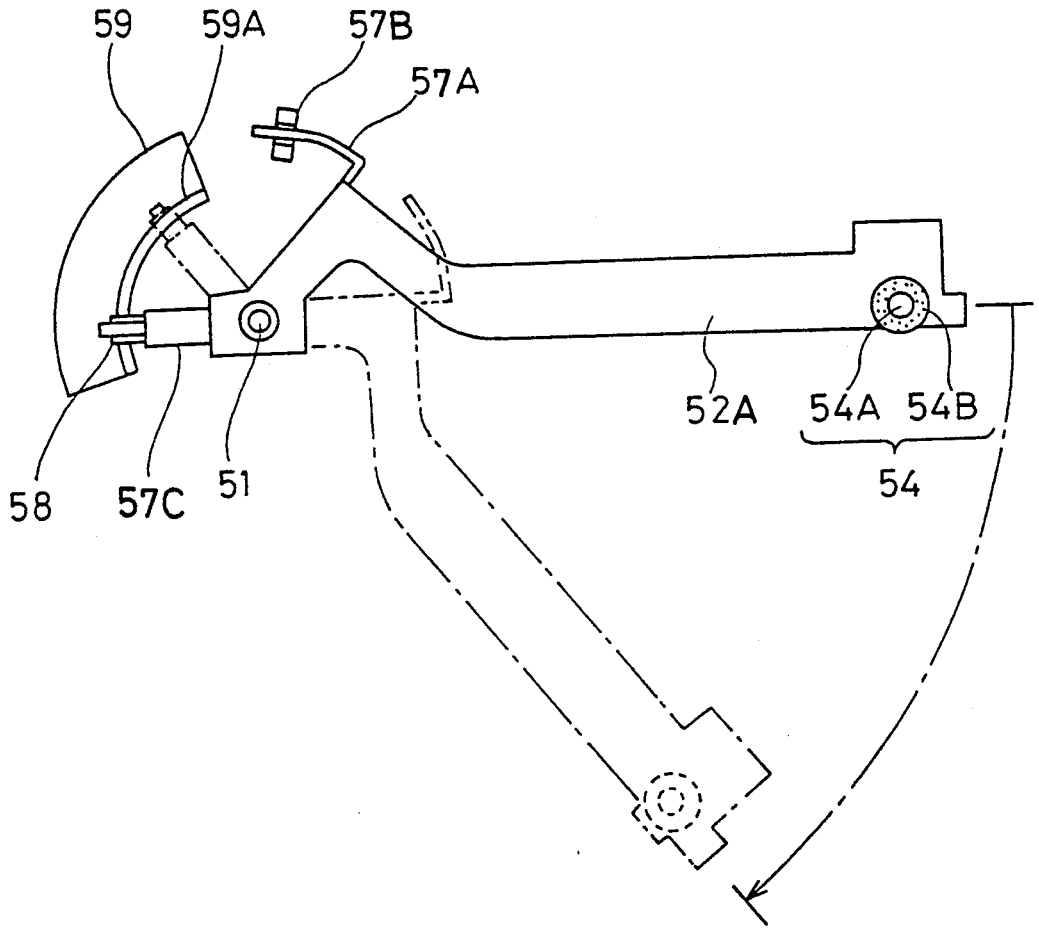
FIG. 7 is a plan view of the alignment device.

As shown in FIG. 7, an arc-shaped curved portion 57A is protruded from a portion of the aforementioned lower arm 52A, and when an optical path of a photo-interrupter 57B is interrupted with the portion 57A, the home position of the lower arm is detected.

The rotating angle of the aforementioned lower arm 52A can be changed when the setting pulse number of the aforementioned pulse motor is changed so that paper P can be aligned in accordance with the size of paper P.

A roller 58 is rotatably engaged with a protruded shaft portion 57C which is protruded from a portion of the aforementioned lower arm 52A. The roller 58 is slidably contacted with a groove cam portion 59A of a cam member 59 which is fixed to the aforementioned frame. Accordingly, when the lower arm 52A is rotated around the shaft 51, the roller 58 is also rotated around the shaft. When the aforementioned rotation is conducted, papers P put on the bin 41 are aligned by the pushing action of the alignment rod 54 at the side of the paper stack.

Figure 10:
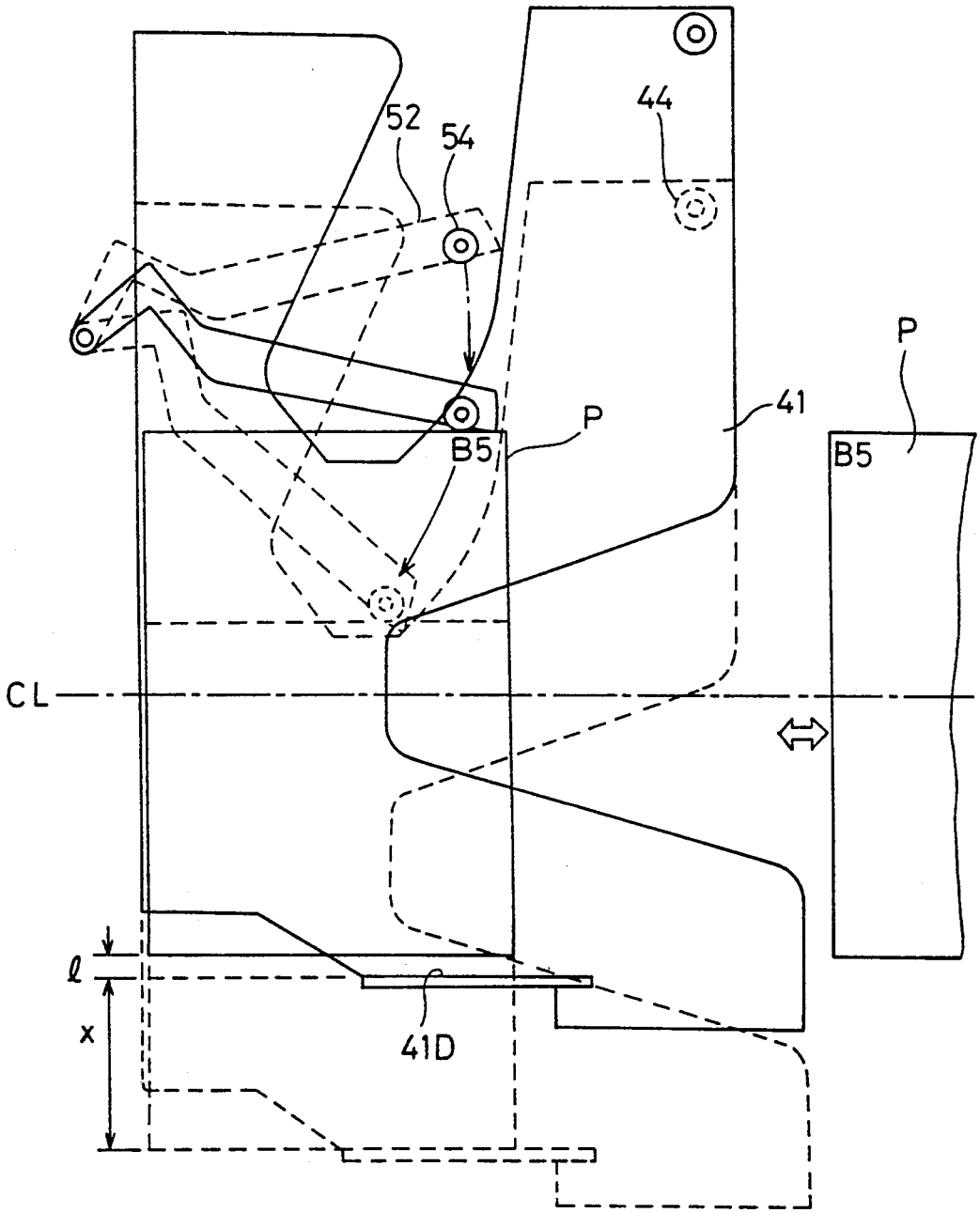
FIG. 10 is a plan view showing straight movement of a bin.

The aforementioned alignment rod 54 moves along a locus which is shown by a one-dotted chain line in FIGS. 4 and 10. On the other hand, in order to insert papers on the bin 41 into a stapling member, the bin 41 is also rotated as shown by a one-dotted chain line in FIG. 4. Since the bin 41 is moved forward and backward, a large opening portion 41C is formed in the bin 41 as shown in the drawing so that the alignment rod 54 can not interfere with the bin 41. Numeral 46 in FIG. 3B is a reinforcing member to reinforce the opening portion 41C of the bin 41 in order to prevent deformation of the bin 41 caused by the opening portion 41C. This reinforcing member 46 is fixed to the side of the bin 41 by screws, and at the same time closes the U-shaped cut out 41G of the bin 41 into which the aforementioned slide member 44 is inserted, in order to prevent the slide member 44 from coming out.

As shown in FIG. 3, a stopper wall 41D is vertically provided on one side of the bin 41. A plurality of protrusions 41DA are formed on the inner side surface of the stopper wall 41D. This inner side surface 41DA is a surface with which the side edge of paper P collides so that paper P can be aligned.

A paper pressing mechanism 60 is provided on an outer side surface 41DB of the stopper wall 41D. A lever 61 is supported by a pivot 62 mounted on the outer side surface 41DB of the stopper wall 41D in such a manner that the lever 61 can be freely turned. Numeral 41E is a guide portion to slidably guide the lever 61. A long and slender shaft is mounted on the tip of the lever 61, and a pipe-shaped member 63 is provided around the shaft with play. The other end of the aforementioned lever 61 is resiliently pressed by a leaf spring 65. Another leaf spring 66 is supported and fixed in the manner of a cantilever at the bending portion located under a position where the lever 61 is pushed by the spring 65. The leaf spring 66 is pushed by a roller 72 mounted on the tip of the arm 71 of a bin turning device 70 (shown in FIGS. 4 and 8).

Figure 8:
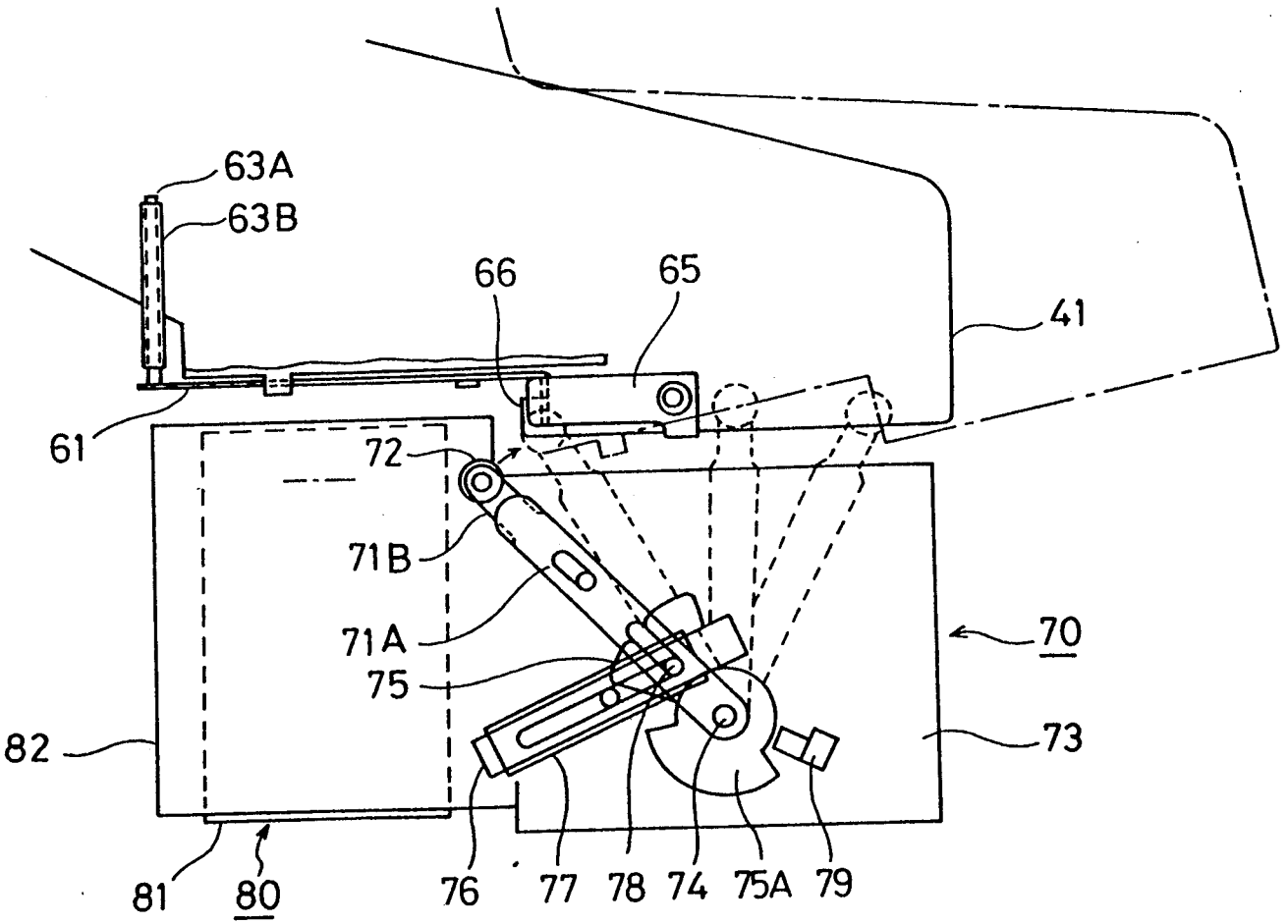
FIG. 8 is a plan view of a bin oscillating device.

FIG. 8 is a plan view of the bin turning device 70 which turns the aforementioned bin 41 and at the same time activates the aforementioned paper pressing mechanism 60.

The bin turning device 70 is mounted on a base plate 73. The first arm 71A is coaxially provided to a rotating shaft 74 which is driven by a motor and reduction gear train not illustrated in the drawing. The second arm 71B having long holes is provided to the first arm 71A in such a manner that it can be slid in the radial direction being pulled by a spring. A rubber coated roller 72 is mounted on the tip of the second arm 71B.

A cam plate 75 is provided to the aforementioned rotating shaft 74, and the cam plate 75 is composed of a U-shaped groove and an arc portion having the same radius.

On the other hand, a follower pin 78 is supported being pulled by a spring, wherein the follower pin 78 penetrates through a long groove portion of a moving member 77 which slides straight on a guide member 76 mounted on a portion of the base plate 73, the aforementioned first arm 71A, and the second arm 71B.

A semicircular shut-off plate 75A is integrally provided at the other end of the aforementioned cam plate 75, so that a photo-interrupter 79 is turned on and off.

When the aforementioned first arm 71A is rotated clockwise as shown by a broken line in FIG. 8, the follower shaft 78 moves the groove portion of the moving member 77 and at the same time moves the groove of the cam plate 75 to the outside. After the follower pin 78 leaves the groove, it slides on the curved surface of the arc portion having an equal radius. Before the aforementioned operation, the shielding plate 75A of the tail portion of the cam plate 75 interrupts the optical path of the photo-interrupter 79 so that the power source is turned off and the rotation of the motor is stopped. Consequently, even when there is some overrun after the motor has been stopped, the follower shaft 78 moves and stops on the arc portion having the equal radius of the cam plate 75, so that the first arm 71A maintains its stop position at a predetermined angle. Accordingly, the bin 41 stops at a predetermined position.

The base plate 73 of the aforementioned bin turning device 70 is mounted on the common frame 82 together with the base plate 81 of the stapling device. The base plate 73 moves vertically to the frame of the aforementioned bin shift section 40, and stops at each bin position. Then, a bundle of papers stacked on the aforementioned rotatable bin 41 being pressed with the aforementioned paper pressing member 63B, enters into a stapling gap of the stapling device to be stapled.

After the bundle of papers have been stapled, the second arm 71B is turned back so that the bin 41 is returned to the original paper discharging position being pulled by a spring.

Next, the stapling operation conducted on the bundle of papers discharged in the bin 41, will be explained as follows.

When the position of a document is determined on the platen glass of the copier 1, there are two practices, one in which the document is set so that the center of the document can coincide with the center line of the platen glass, and the other in which the document is set so that one side of the document can coincide with one side of the platen glass. The stapling operation conducted in the latter case will be explained here.

Figure 9:
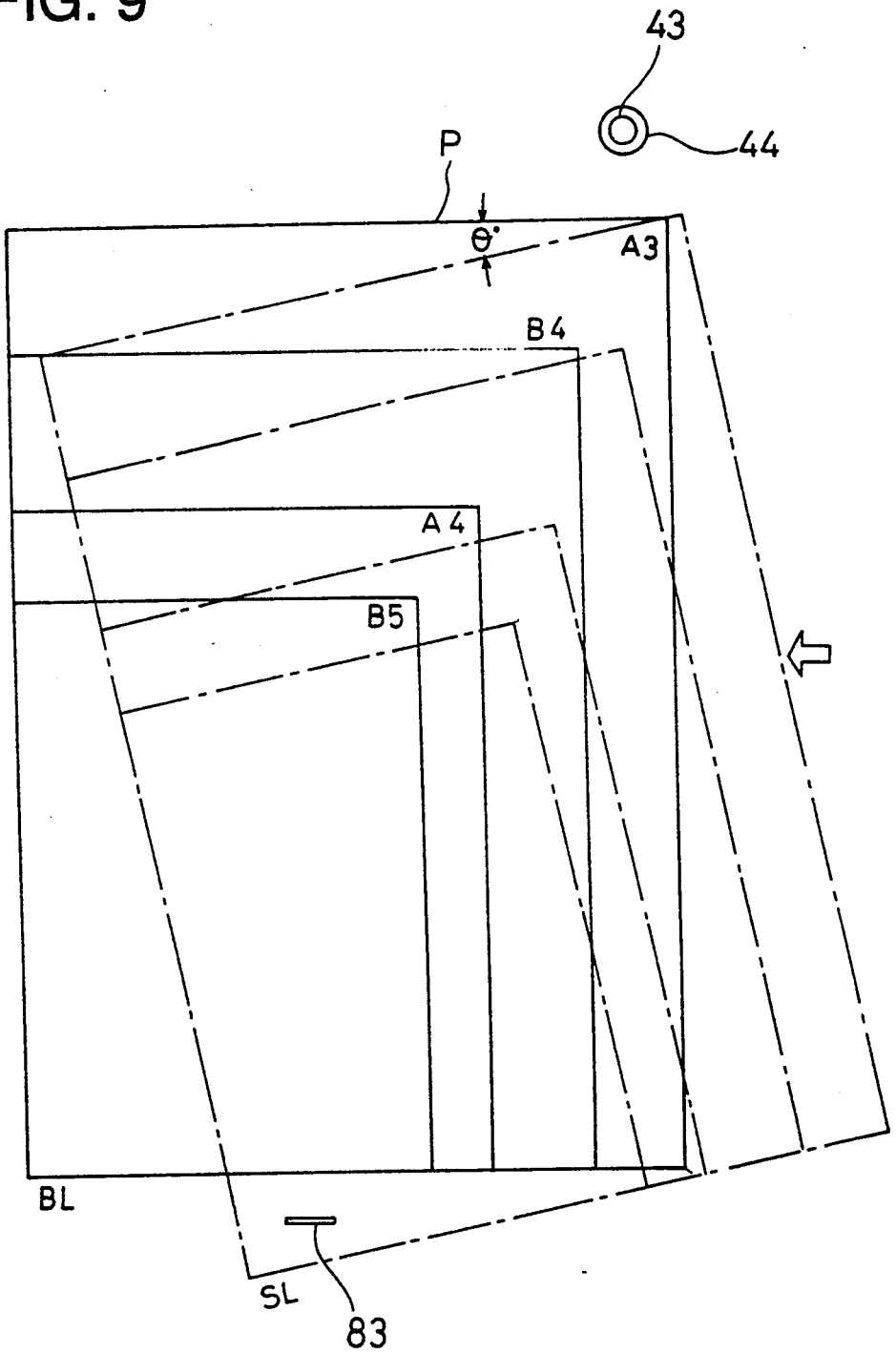
FIG. 9 is a plan view showing the process of oscillation of various sizes of papers which are set in such a manner that the sides of the papers are set along the center of the apparatus.

FIG. 9 is a plan view showing the progress of movement of paper P when the aforementioned bin 41 is turned around.

(1) Papers P discharged from the recording apparatus 1 are pressed against the side stopper wall 41D by the pushing alignment rod 54 one by one so that the sides of papers P can be aligned along base line BL.

(2) When it is detected that a predetermined number of papers are held in the bin 41, the second arm 71B of the aforementioned bin rotating device 70 starts turning. The roller 72 mounted on the tip of the second arm 71B pushes the stopper wall 41F (FIG. 3A) protruded at the side portion of the bin 41, via the spring 66 used for a buffer. Then, the lever 61 is turned against the force of the leaf spring 65, and the paper pressing member 63B presses the bundle of papers from the upper side so that the slippage of papers can be prevented.

(3) When the aforementioned second arm is further turned, the bin 41 is turned around the slide member 44 while the papers are pressed in the manner described above, and the bin 41 reaches a position shown by a one-dotted chain line in FIG. 4. Then, the papers stacked on the bin 41 reach a position shown by a one-dotted chain line in FIG. 9 and stopped (a staple line SL).

(4) In this position, the leading edge portion of the papers is inserted into a gap formed in the stapling device 80, and a staple is driven into the papers.

(5) After the stapling operation has been completed, the arm 71B is driven back to its initial position, and the bin 41 is returned to the original position by the force of a spring, and at the same time the paper pressing member 63B is separated from the surface of the bundle of papers so that the bundle of papers can be taken out from the bin 41.

(6) After a stapling operation of the uppermost bin 41 has been completed, a common frame 82 in which the stapling device 80 and the bin rotating device 70 are integrally formed, is lowered by a drive source, and then a bin 41 located below the uppermost bin is turned around and a stapling operation is conducted in the same manner. While the aforementioned stapling operation is being conducted, papers are sent on a bin located below the aforementioned bin to be stacked.

The stapling operation conducted in such a manner that the sides of papers are aligned along the side stopper wall 41D (base line BL), is described above. Next, the stapling operation in which the center of papers coincide with center line CL, will be explained.

The first method is as follows:

Each of the papers discharged from the image recording apparatus 1 is pushed by the aforementioned alignment rod 54 so that the paper can be bumped against the side stopper wall 41D so as to be aligned in a position shown in FIG. 9. After that, the bin 41 is turned around and the papers are stapled in the same manner as described before. Although the drive structure of this method is simple, the displacement amount of paper on the bin differs according to the paper size. In particular, in the case of a small-sized paper (for example, B5 size paper), the displacement amount on the bin 41 is large, so that alignment may not be conducted properly.

The second method is as follows:

The entire bin movement section 40 including the bins 41 is moved forward in a direction perpendicular to the paper discharging direction so that a bundle of papers can be moved to base line BL. Then the bin 41 is turned around in the same manner as described before so that the bundle of papers are stapled.

Figure 11:
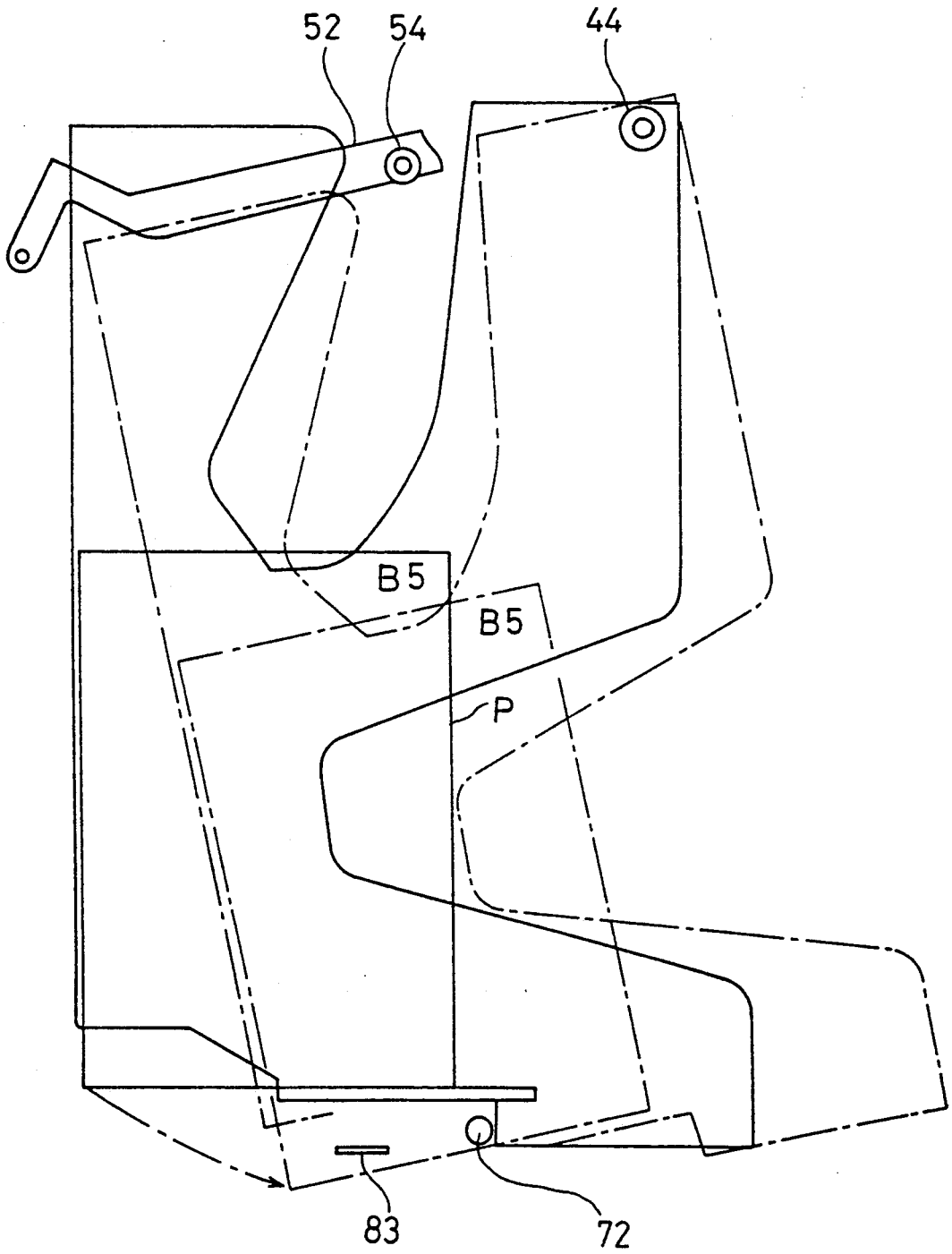
FIG. 11 is a plan view showing the oscillation process of the bin.

A stapling operation conducted according to this method is shown in FIGS. 10, and 11. This stapling operation will be explained as follows.

(1) After the size of paper (copy paper) discharged from the copier 1 is manually set or automatically judged beforehand, the bin moving section 40 of the sorter is electrically driven. When the bin moving section 40 has come to a predetermined position corresponding to the aforementioned paper size, the movement of the bin moving section 40 is stopped and the sorter is placed in a waiting condition. When the sorter is located in this waiting position, the side stopper wall 41D of the bin 41 is located in a position separated from the side of paper P by l (for example, about 10 mm).

(2) Under the aforementioned condition, paper P advances from the left in the drawing into a bin, sent, and along the inclined surface of the bin 41. After that, paper P slips down by its own weight and comes back to contact with the front stopper 41S of the bin 41.

(3) After the movement of paper P has stopped, the alignment rod 54 is worked, and one side of paper P is pushed so that paper P is moved by the displacement amount l to this side, and the other side of paper P is contacted with the stopper wall 41D. This displacement amount l is set to almost the same value even in the case in which paper sizes are different (for example, A4 size, B4 size and A3 size).

(4) Then, the bin movement section 40 is electrically driven to this side, and stopped in a predetermined position common to papers of each size. This displacement amount x is determined to a value (for example, 87.4 mm) obtained in such a manner that: a value found when the minimum paper size (for example, B5 size, 257 mm) is subtracted from the maximum paper size (for example, 17 inches), is divided by 2. In the meantime, the side of a bundle of papers on the bin 41 is pushed by the alignment rod 54 so as to be moved.

(5) FIG. 11 is a plan view showing the progress of turning of a bin when a stapling operation is conducted. When a stapling signal is inputted into the bin movement section 40 which is in a stopped condition, first the aforementioned bin turning device 70 is driven, and then the arm 71B is rotated so that the roller 72 mounted on the tip of the arm pushes one end of the aforementioned paper pressing mechanism 60. The bin 41 is turned around the slide member 44 (the turning angle is about 12°), and a staple 83 is driven as described above.

(6) The stapler 80 which is provided integrally with the bin turning device 70, successively ascends or descends, and performs stapling operation in the second and third bins in the same manner as the first bin. Each stapling operation is conducted until the number of stapling operation is compared with the number of copying with regard to each document and both numbers become the same. Then all the operations have been completed, the stapler 80 returns to the stapling position of the first bin, and is put to a waiting condition.

(7) At the same time, when all bundles of papers have been stapled, the bin moving section 40 returns to a home position and returns to a waiting condition. This home position may be a position where the bin moving section 40 is advanced most or a position where the bin moving section 40 is withdrawn most.

As described above, according to the present invention, the rotative shaft which passes through all bins is provided at one end of the sorter body, and the bin turning device is provided at a working point of the other end so that the bins can be turned and papers can be moved to the stapling position. Consequently, the stapling positions of all bins can be stabilized, and the stapler can be positioned with regard to papers by a simple operation. Accordingly, a bundle of papers can be accurately and properly stapled.

Next, a specific embodiment of a bin turning device will be described in which locking caused when a bin is rotated can be prevented, the bin can be smoothly rotated, and the bin can be rotated with a low torque, wherein the structure of the bin turning device is simple and the operation is conducted positively.

The bin turning device according to the present invention comprises an arm means, and the arm means has a double arm structure composed of the first arm member which is rotated by a cam means driven by a drive source of the bin turning device, and the second arm member which is held so that it can be relatively moved in the direction of the radius of gyration of the first arm member, wherein the aforementioned bin is moved when the arm is rotated.

The bin turning device of the present invention comprises an arm means which rotates the aforementioned plurality of bins individually, and the aforementioned arm means includes the first arm member which is rotated by a cam means driven by a drive source of the aforementioned bin turning device, and the second arm member which is rotatably supported around a rotating shaft provided at one end of the aforementioned first arm member, being pulled by a spring, and the aforementioned bin is moved when the arm is rotated.

A roller which is rotatably provided at the tip of the aforementioned second arm member, comes into contact with a stopping surface of the aforementioned bin, and the bin is moved when the second arm is rotated.

The aforementioned second arm member is held by the first arm member being pulled in the radial direction by a spring, and when an overload is given to the second arm during the turning of the bin, the second arm member is withdrawn so that the overload can be absorbed by a spring action.

Figure 12:
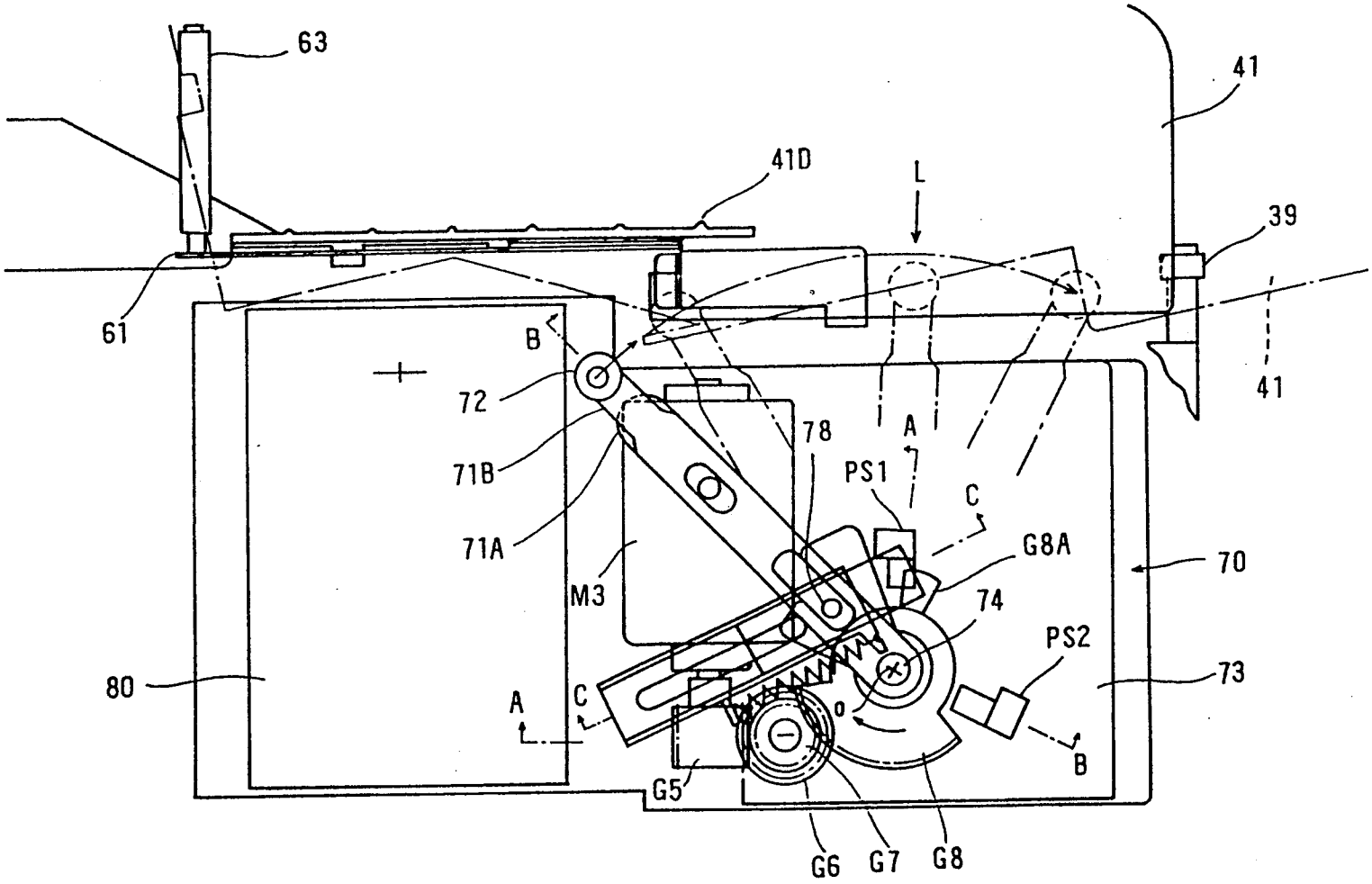
FIG. 12 is a plan view of a bin oscillation device.
Figure 13:
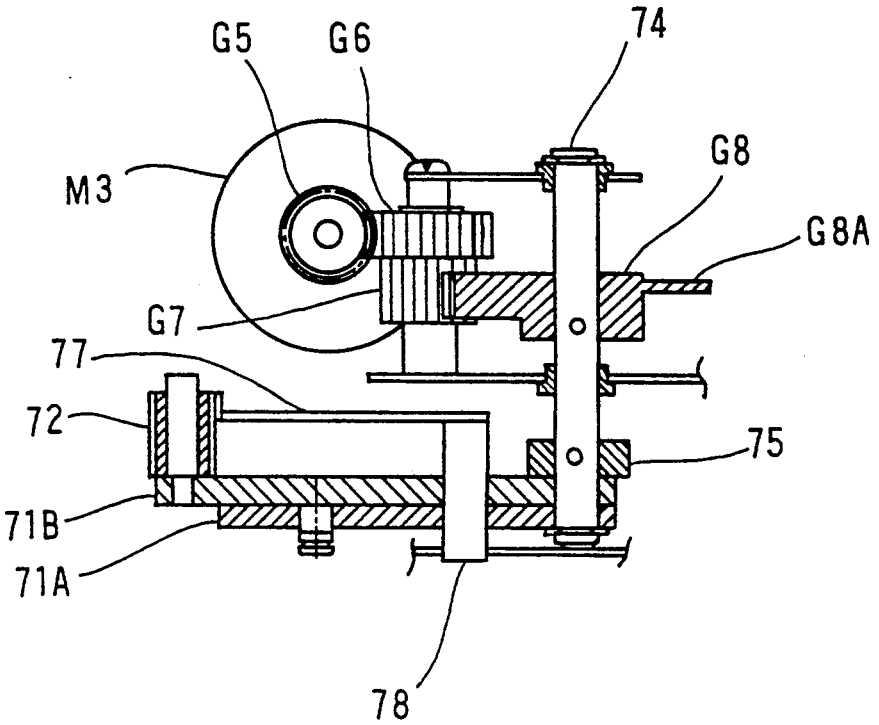
FIG. 13 is a front sectional view of the bin oscillation device.
Figure 14:
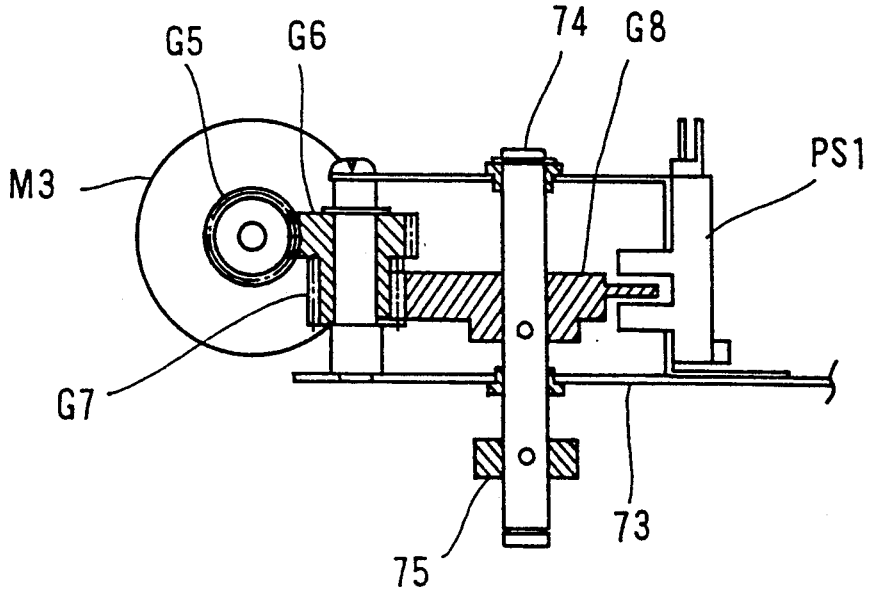
FIG. 14 is a sectional view taken on line A-O-A of the bin oscillating device.

FIG. 12 is a plan view of a unit into which a bin turning device 70 to rotate the bin 41 and actuate the aforementioned paper pressing mechanism 60, and an electrically-driven stapler 80, are assembled. FIG. 13 is a front sectional view of the bin turning device 70, and FIG. 14 is a sectional view taken on line A-O-A.

The bin turning device 70 is mounted on a base plate 73. Reversible motor M3 fixed to the base plate 73 rotates clockwise sector shaped gear G8 and a rotating shaft 74 integrated with gear G8, through a transmission system composed of worm gear G5 and intermediate gears G6, G7. A sector shaped shielding section (an actuator) G8A is integrally formed with the sector shaped gear G8, and passes through photo-interrupters PS1, PS2 so that the photo-interrupters can cause turn on and off action.

Figure 15:
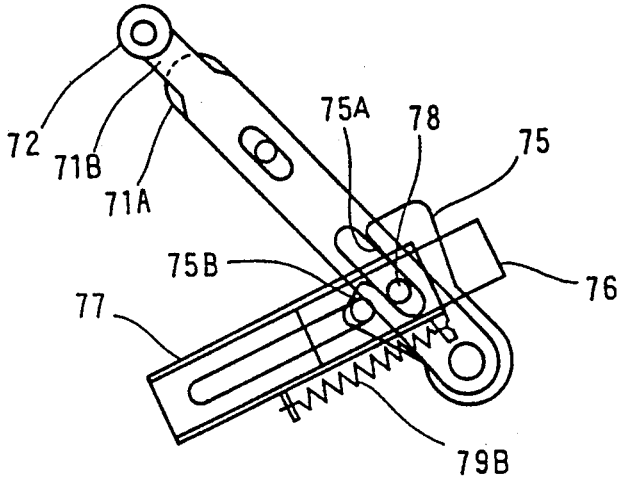
FIG. 15 is a plan view of the lower mechanism of the bin oscillating device.
Figure 16:
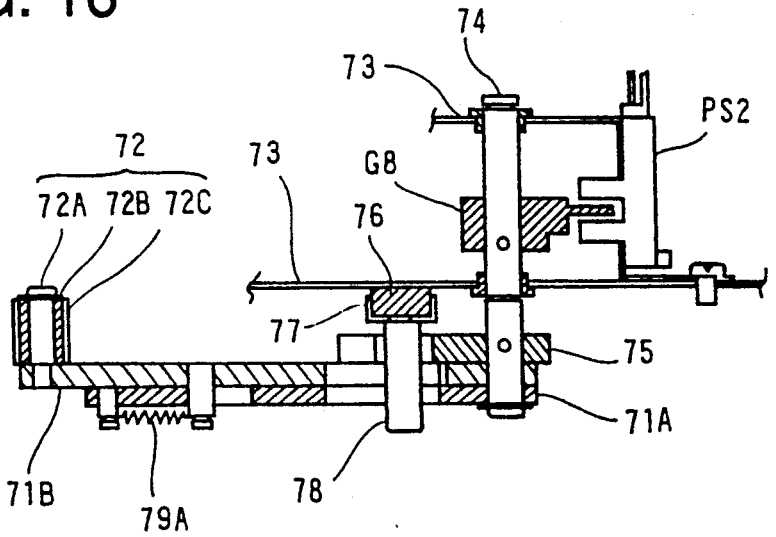
FIG. 16 is a sectional view taken on line B-O-B of the bin oscillating device.
Figure 17:
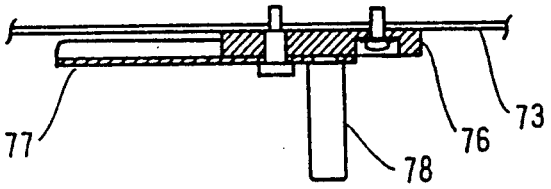
FIG. 17 is a sectional view taken on line C—C of the bin oscillating device.

FIG. 15 is a plan view showing a mechanism of the lower portion of the bin turning device 70. FIG. 16 is a sectional view taken on line B-O-B of the bin turning device 70 in FIG. 12. FIG. 17 is a sectional view taken on line C—C.

A cam plate (a cam member) 75 is fixed to the aforementioned rotating shaft 74. The cam plate 75 is composed of a slot 75A and an arcuate portion 75B of an equal radius. The first arm 71A is rotatably provided on the same shaft as that of the rotating shaft 74. The second arm 71B having a slotted hole is provided to the first arm 71A in such a manner that the second arm 71B can be freely slid in a radial direction being pulled by a tension spring 79A. A roller 72 including a fixing pin 72A, a rotatable ring 72B and a rubber coating 72C coated on the peripheral surface of the ring 72B, is rotatably provided at the tip of the second arm 71B.

A follower shaft 78 mounted on a moving member 77 which can be slid along a guide member 76 provided on the base plate 73, resisting the force of a tension spring, penetrates through a slot of the cam plate 75, a long groove of the first arm 71A, and a long groove of the second arm 71B, wherein the follower shaft 78 is pulled by a spring.

Figure 6:
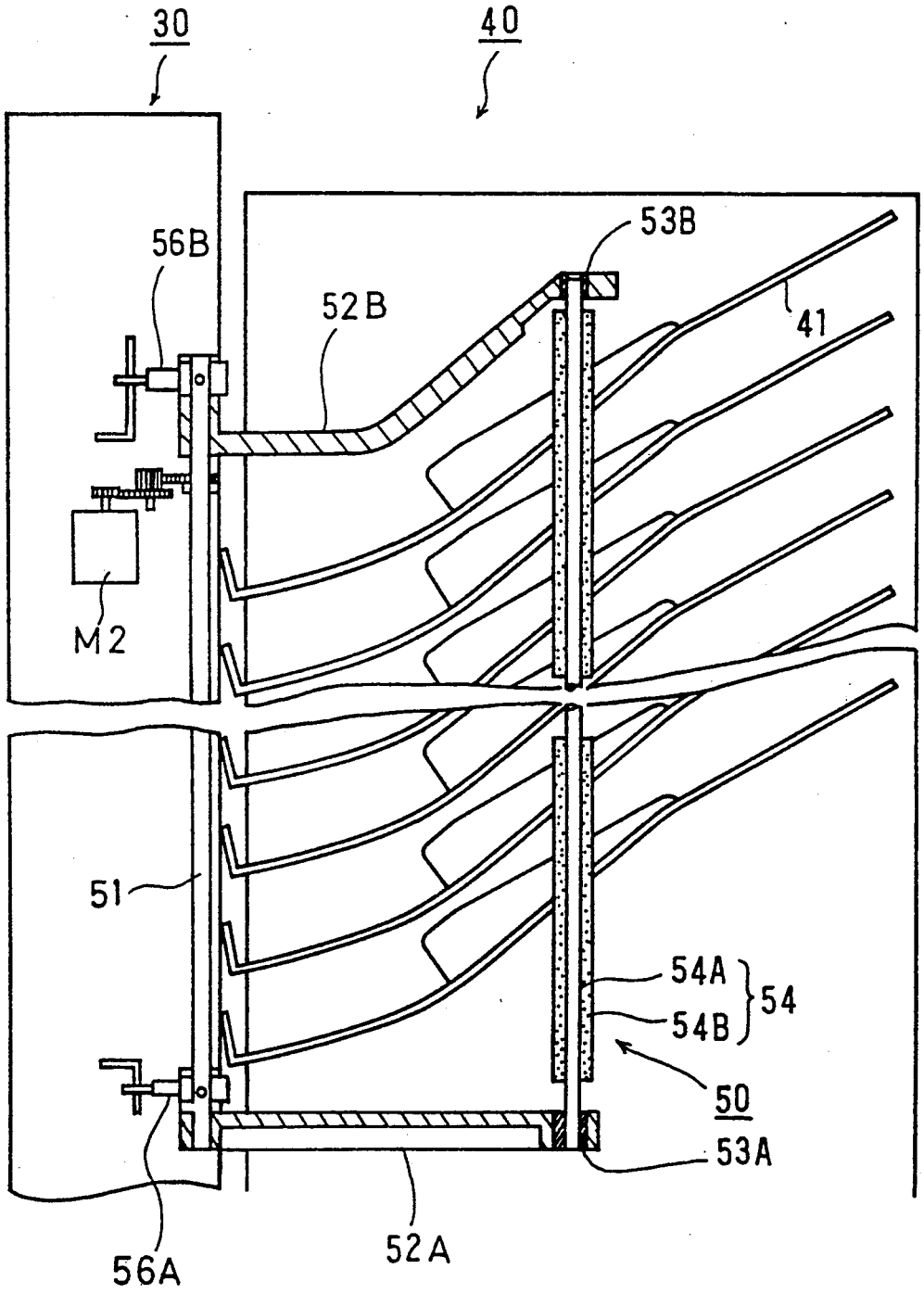
FIG. 6 is a front sectional view of an alignment device.

When motor M3 rotates, the cam plate 75 integrally formed with the rotating shaft 74 is rotated, and a side wall of the groove 75A of the cam plate 75 moves the follower shaft 78 along the guide member 76 together with the moving member 77. At the same time, the follower shaft 78 rotates the first arm 71A clockwise as shown by a broken line in FIG. 6. Accordingly, the follower shaft 78 moves the moving member 77 straight, and moves the groove 75A of the cam plate 75 outwardly so that the first arm 71A can be turned. After leaving the groove 75A, the follower shaft 78 slides on a curved surface of the arcuate portion 75B of which the radius is equal. Previously to the aforementioned operation, shielding portion G8A of sector shaped gear G8 intercepts an optical path of photo-interrupter PS2, so that the power supply is cut off and motor M3 is stopped. Consequently, even when motor M3 overruns after it has been stopped, the follower shaft 78 stops while it moves on the arcuate portion 75B of equal radius of the cam plate 75, so that the first arm 71A and the second arm 71B maintain their stop positions of a predetermined angle. Consequently, the bin 41 stops at a predetermined position.

The arms 71A, 71B constitute a double structure, being extended by the force of a tension spring 79A. When the arms 71A, 71B arrive at a position (a position close to point L in FIG. 12) where a locus of the stopping surface of the bin 41 crosses with a locus of the roller 72 in a bin rotating operation, an overload is given to the roller 72. However, the second arm 71B, which can be moved, is relatively moved with regard to the first arm 71A which is rotated at a fixed position, so that the aforementioned overload can be absorbed by the action of the tension spring 79A. Accordingly, the roller 72 rotates smoothly while being contacted with the contact portion 41E of the bin 41 with pressure, and the bin 41 is turned around the fixed shaft 43.

Figure 18:
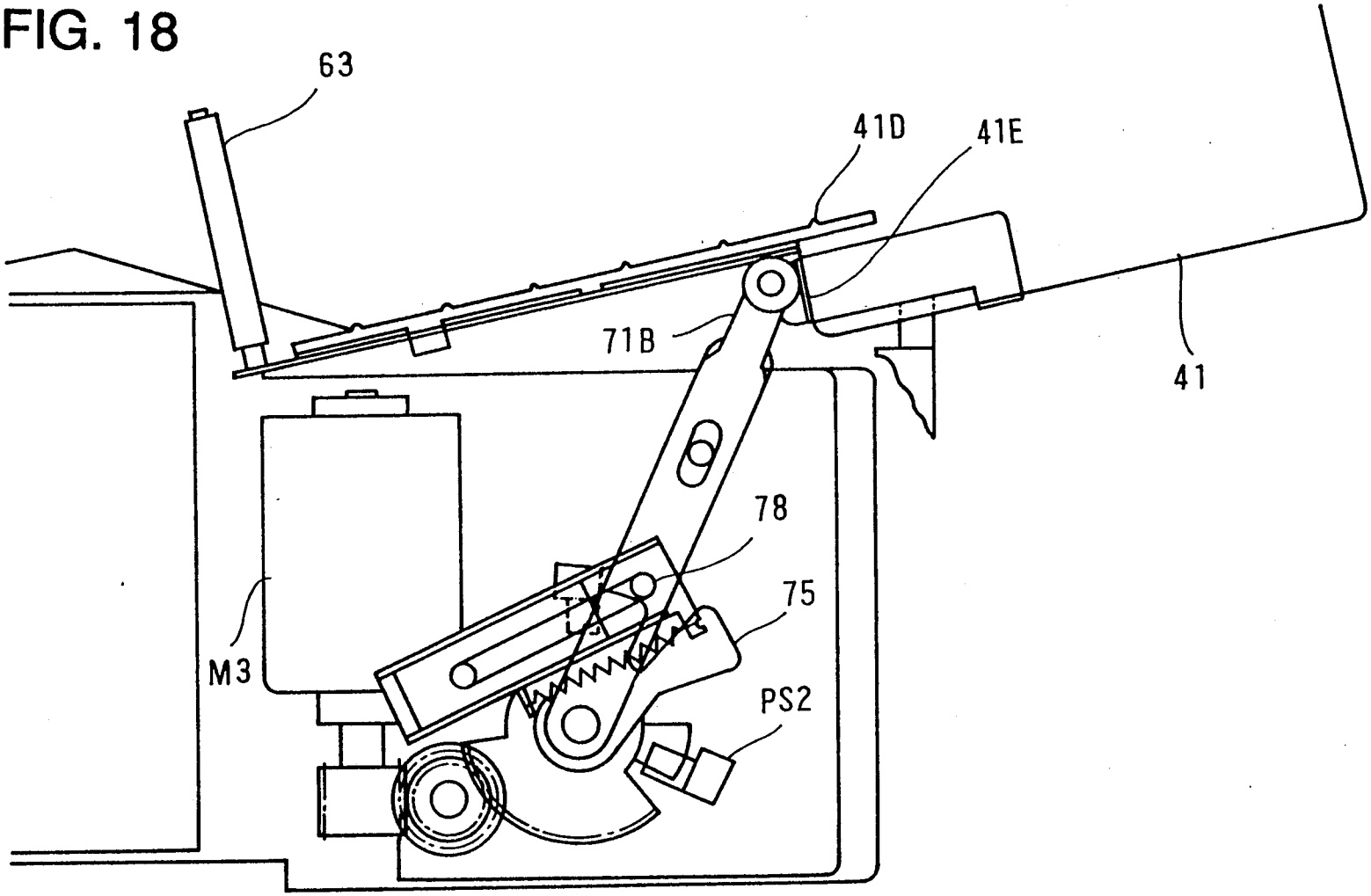
FIG. 18 is a plan view of the bin oscillating device which is in a stapling position.
Figure 19A:
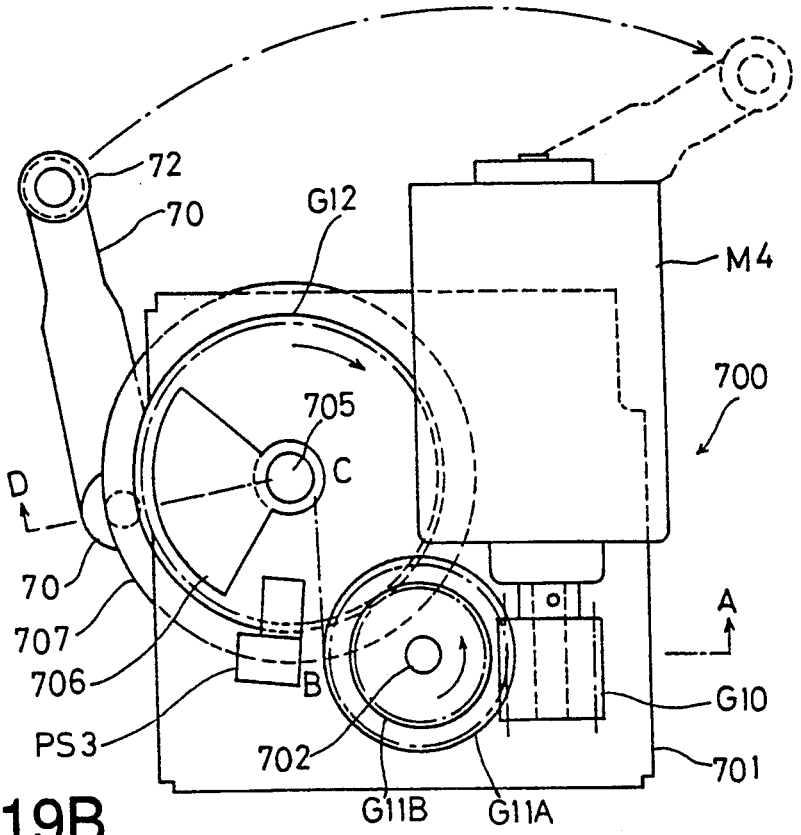
FIG. 19 is a plan view and a sectional view taken on line A-B-C-D of the bin oscillating device according to the second example.
Figure 19B:
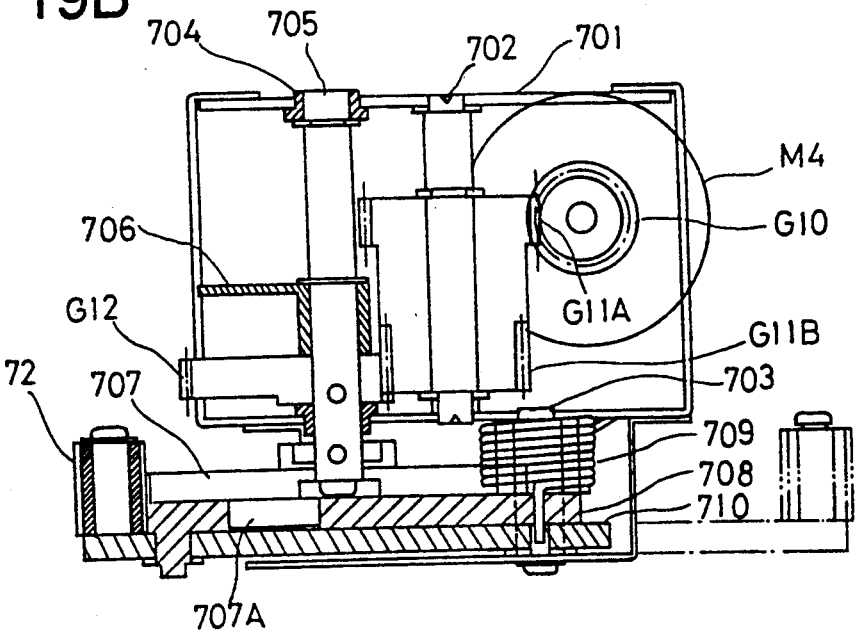

FIG. 18 shows final positions of the arms 71A, 71B in an advancing stroke. A staple is driven when the bin 41 is at this final position.

The second embodiment of the bin turning device according to the present invention is illustrated in FIG. 19 to FIG. 22. FIG. 19(A) is a plan view of a bin turning device 700, and FIG. 19(B) is a sectional view taken on line A-B-C-D in FIG. 19(A).

Motor M4, an intermediate shaft 702, shaft 703, and photo-interrupter PS3 are fixed on a base plate (a frame) of a bin turning device. A drive shaft 705 is rotatably provided to bearings 704 which are installed in the upper and intermediate portions of the frame 701. Worm gear G10 fixed to a main shaft of DC motor M4 rotates gear G12 fixed to a drive shaft 705 in an arrow direction shown in the drawing, through intermediate gears G11A, G11B rotatably provided to the intermediate shaft 702.

A sector shaped shielding member 706 is fixed to an intermediate portion of the drive shaft 705, and a cam member 707 is fixed to a lower end of the drive shaft 705. A cam protrusion 707A is integrally formed on a lower side of the cam member 707.

Figure 20A:
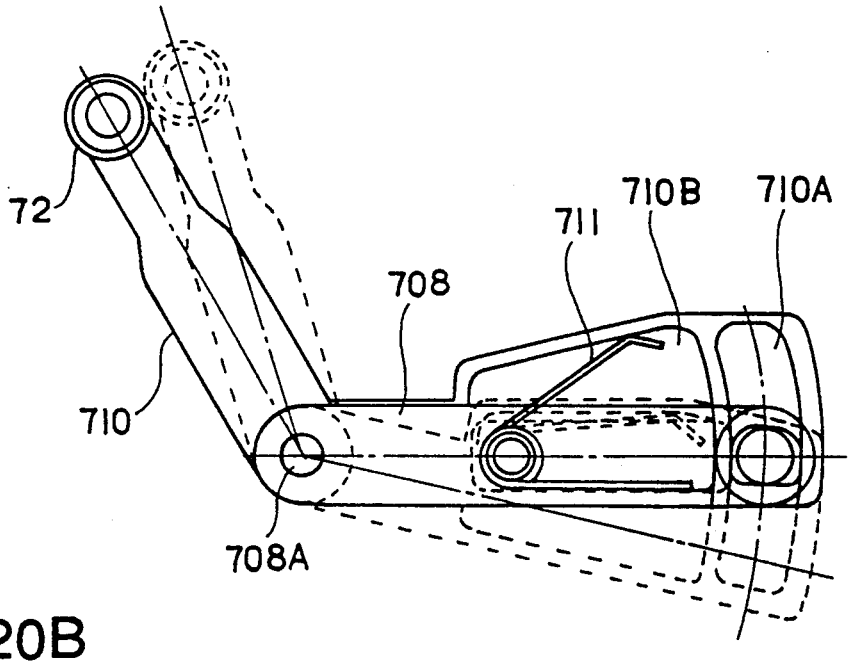
FIG. 20 is a plan view and a front sectional view showing the relative relation between the first and the second arm.
Figure 20B:
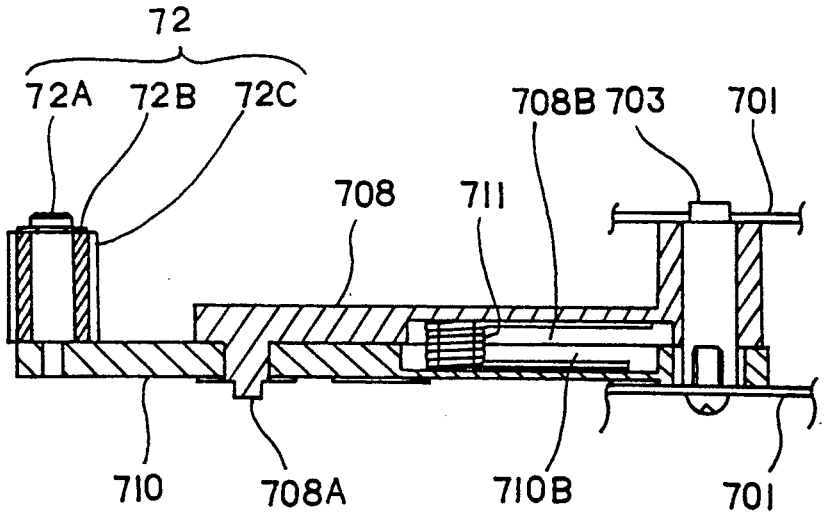

FIG. 20(A) is a plan view showing a partial assembling state of the first and second arms 708, 710, and FIG. 20(B) is a front sectional view of the first and second arms 708, 710.

The first arm 708 is fixed to the shaft 703 provided to a lower portion of the base plate 701, and pushed by a torsion spring 709. A boss 708A protruded from a left end portion of the first arm 708, is rotatably engaged with a hole formed in the middle portion of the second arm 710. Therefore, the second arm 710 can be rotated around the boss 708A with regard to the first arm 708.

A fixed pin 72A is fixed to the left end of the second arm 710, and a roller 72 composed of a rotatable ring 72B covered with a rubber ring 72C is rotatably provided to the fixed pin 72A.

A right end portion of the second arm 710 has a sector shaped portion as shown in FIG. 20, and a slot 710A is formed in the right end portion. Accordingly, the slot 710A serves as a clearance slot so that the second arm 710 can not come into contact with the aforementioned shaft 703 when being rotated. Cut-out portions 708B, 710B are formed in the middle portions of the first and second arms 708, 710, and a torsion spring 709 or 711 is provided in these cut-out portions so that the arms can be expanded.

Figure 21:
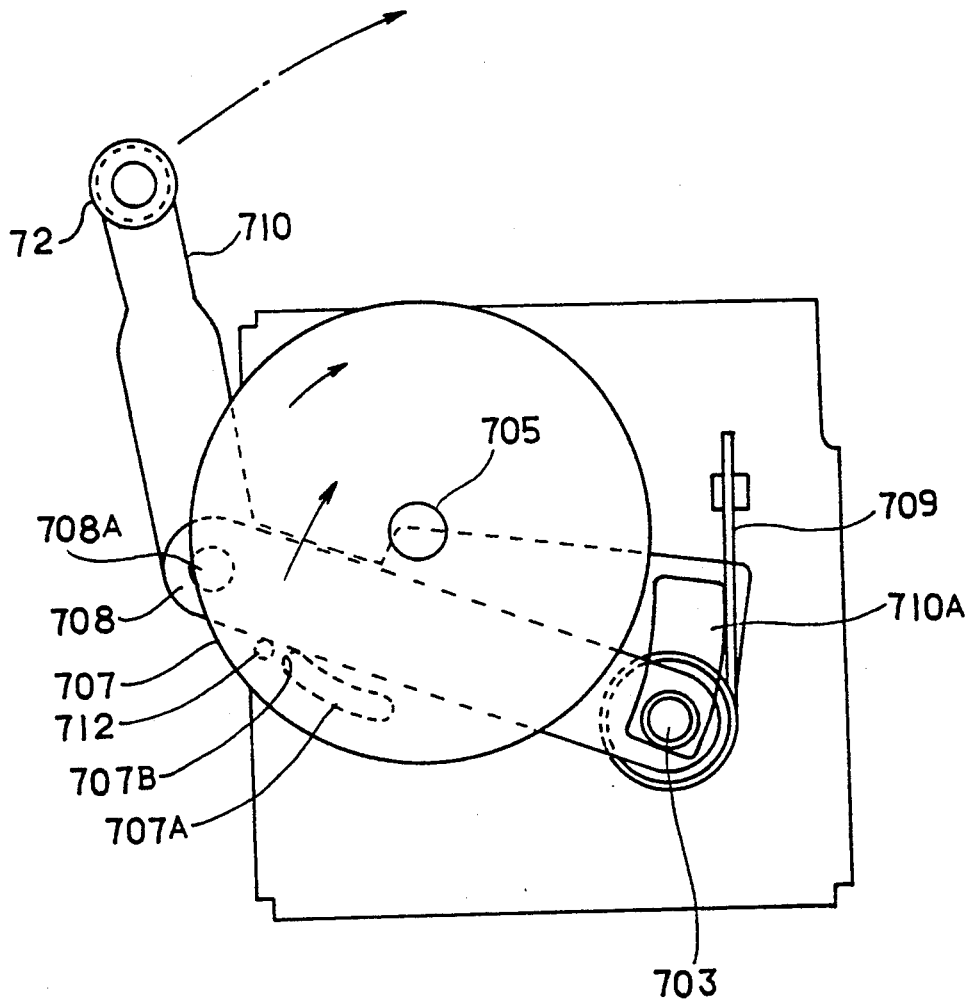
FIG. 21 is a plan view of the bin oscillating device at the start of arm oscillation.

FIG. 21 is a plan view showing a shape of the bin turning device 700 when its operation is started. In this state, the first arm 708 supported by the shaft 703 is pushed by a torsion spring 709 counterclockwise, and stopped by a stopper pin 712. The second arm 710 pivotally supported by the boss 708A of the first arm 708 is pushed by the torsion spring 711 counterclockwise, and stopped when contacted with an end portion of the slot 710A.

When motor M starts in the state mentioned above, the drive shaft 705 and the cam member 707 are rotated normally through the aforementioned gear transmitting system G10, G11A, G11B, and G12. Then, a tip 707B of the cam protrusion 707A pushes a side wall of the arm 708, and rotates the first arm 708 clockwise as in the drawing (FIG. 21, 22). At the same time, the second arm 710 which is connected with the first arm 708 being expended by the torsion spring 711, is also rotated clockwise. The roller 72 mounted on the tip of the second arm pushes a stopping surface of the bin 41, and moves the bin 41 to a stapling position as described in the first embodiment.

Figure 22:
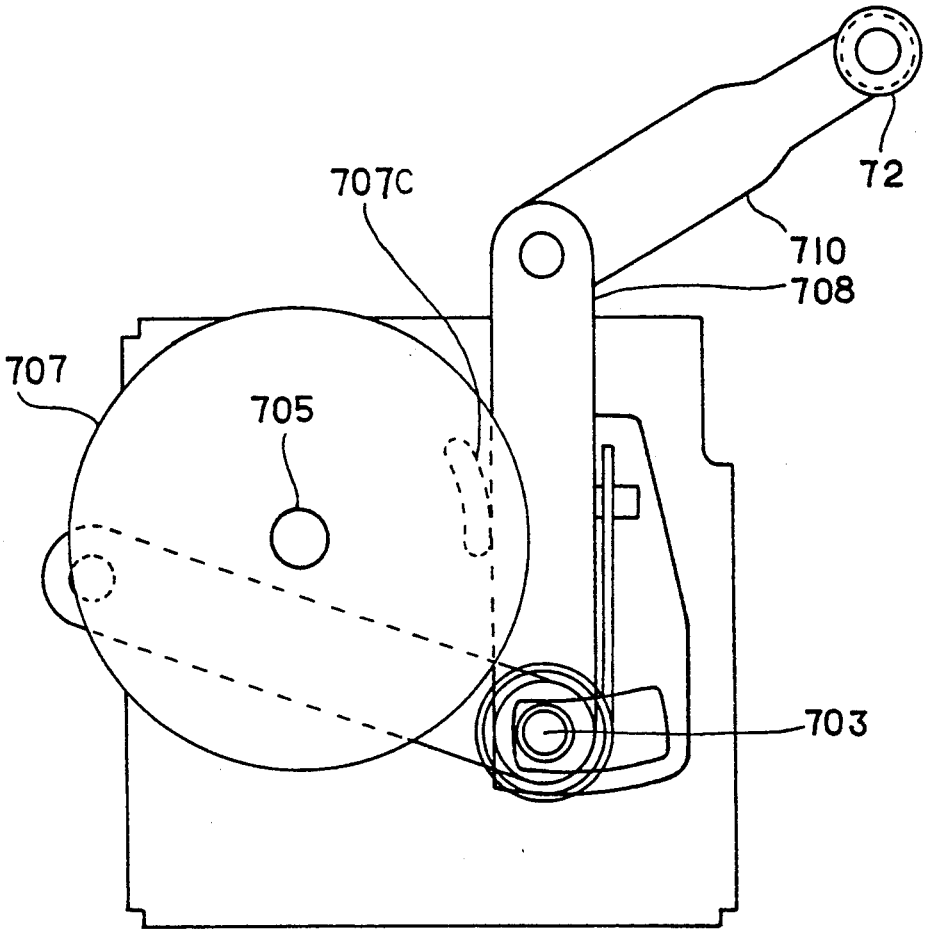
FIG. 22 is a plan view of the bin oscillating device at the end of arm oscillation.

FIG. 22 is a plan view showing a state in which the bin turning device 700 has completed its rotation. When the first and second arms 708, 710 have completed their rotating motion, a shielding member 706 composed integrally with the aforementioned drive shaft 705 intercepts an optical path of photo-interrupter PS3, and motor M4 is stopped by its detection signal. However, the drive shaft 705 continues rotation for a while, and then stops. During the coasting rotation of the drive shaft 705, an equal radius arcuate portion 707C of the cam protrusion 707A of the cam member 707 pushes a side wall of the first arm 708. When the equal radius arcuate portion 707C is slidably rotated in the aforementioned manner, the rotation of the first arm 708 around the shaft 703 is stopped, so that the turning of the bin 41 by the roller 72 mounted on the tip of the second arm 710 is stopped. In the aforementioned bin stop position, a staple is driven into a bundle of papers on the bin 41 by the stapler 80.

The arms 708, 710 have a double structure, being pushed by the force of a torsion spring 711 so that the arms can be formed into one body. When the arms 708, 710 arrive at a position (a position close to point L in FIG. 12) where a locus of the stopping surface of the bin 41 crosses with a locus of the roller 72 in a bin rotating operation, an overload is given to the roller 72. However, the second arm 710, which can be moved, is forced to rotate around the boss 708A of the first arm 708 so that the torsion spring 711 absorbs the aforementioned load (a broken line position in FIG. 20(A)). Accordingly, the roller 72 is smoothly rotated while being contacted with the contact portion 41E of the bin 41 with pressure, and the bin 41 is turned around the fixed shaft 43 to the final position passing through point L.

After the stapler has been driven at the finaly turned position of the bin 41, motor M4 rotates reversely by the detection signal, and returns the arms 708, 710 to their initial positions in cooperation with the torsion springs 709, 711.

In the aforementioned first and second embodiments, the second arm members 71B, 710 have a double structure, being extended with regard to the rotating first arm members 71A, 708 which are driven, or being freely bent. The second arm members 71B, 710 are rotated in such a manner that they come into contact with the stopping surface 41E and follow it when the bin 41 is rotated, while the second arm members 71B, 710 are extended or bent.

When the locus of the bin 41 crosses with the locus of the second arm members 71B, 710, the second arm members 71B, 710 are displaced with regard to the first arm members 71A, 708, so that locking of rotation does not occur. However, the reaction force caused when the second arm members 71B, 710 are displaced, resisting a spring force, is given to the stopping surface 41E of the bin 41. Therefore, there is a possibility that the bin 41, the second arm members 71B, 710, the first arm members 71A, 708, and the stopping surface 41E of the bin 41 are deformed, or interference between parts occurs to cause a mechanical breakdown. Since the stopping surface 41E of the bin 41 is connected with the lever 61 which actuates the paper aligning device 60, papers stacked on the bin 41 can not be aligned properly when the stopping surface 41E is deformed.

The third embodiment according to the present invention is to solve the aforementioned problems, and to prevent problems of paper alignment in such a manner that: the second arm member is moved along a locus which does not interfere with a locus of the bin; deformation of the bin, arm member, and bin stopping surface are prevented.

Figure 23:
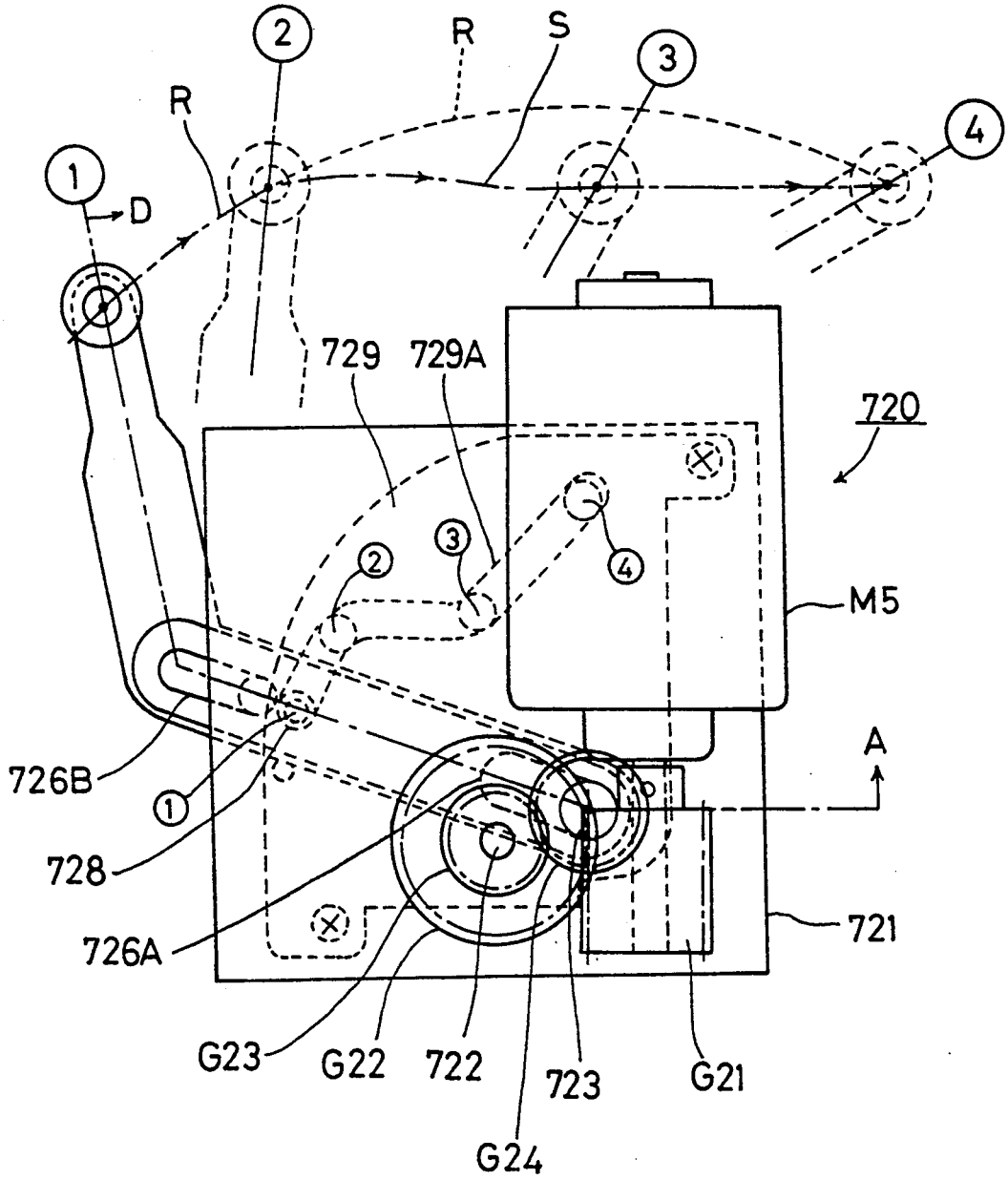
FIG. 23 is a plan view of the bin oscillating device in the third example.
Figure 24:
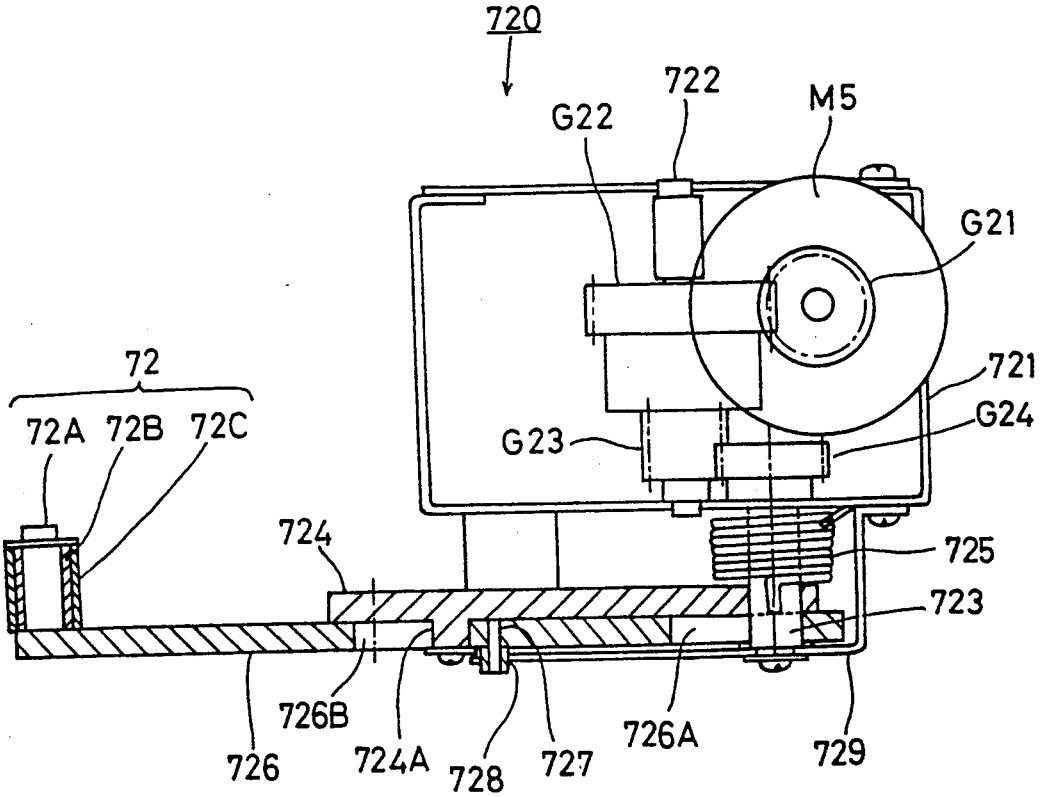
FIG. 24 is a sectional view of the bin oscillating device.
Figure 25:
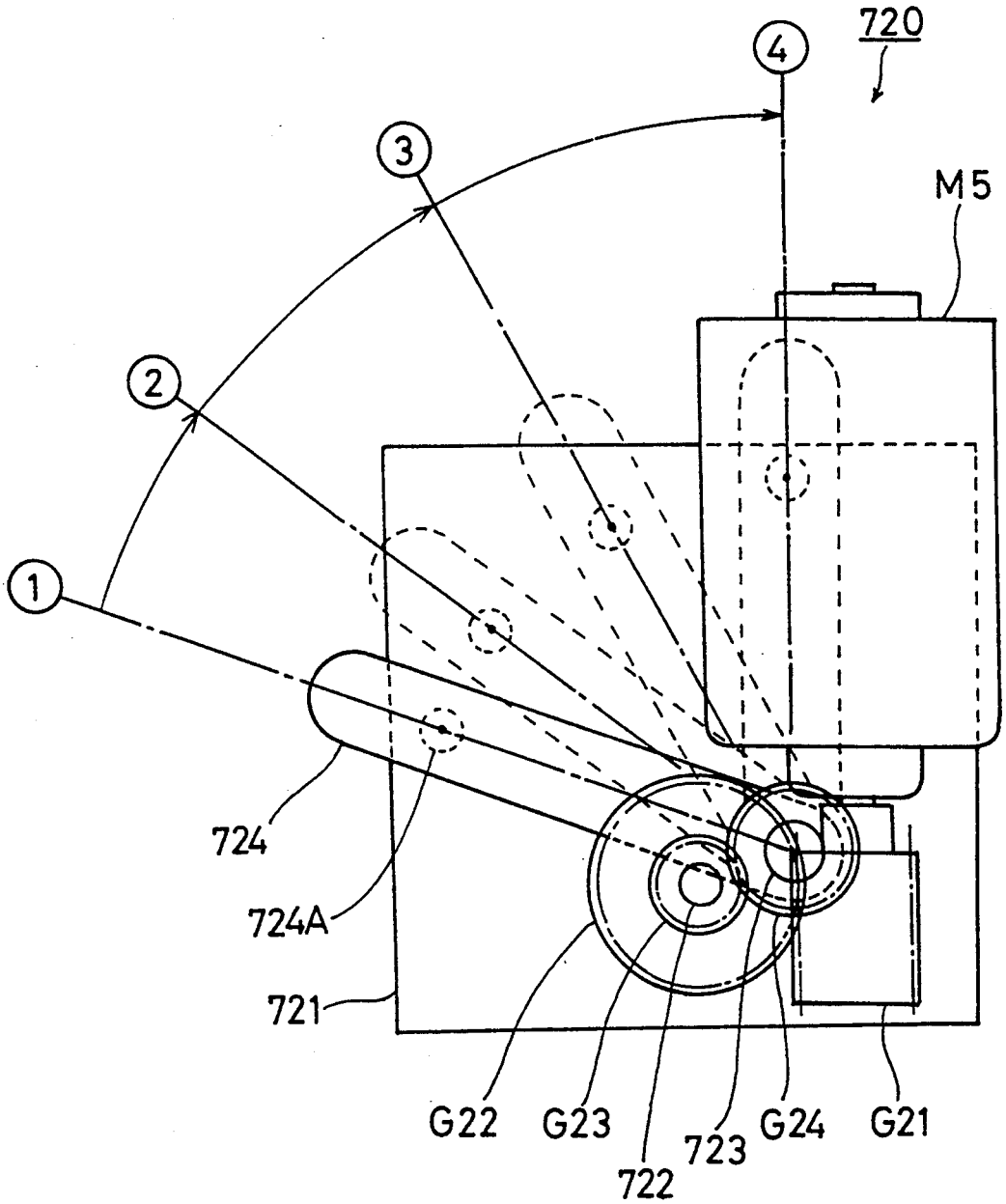
FIG. 25 is a plan view of the drive system of the bin oscillating device.

FIG. 23 is a plan view of a bin turning device 720 of the third embodiment in which the aforementioned problems are solved. FIG. 24 is a sectional view of the bin turning device 24 taken on line A-B-C-D in FIG. 23. FIG. 25 is a plan view of a drive system of the bin turning device 720.

DC motor M5, intermediate shaft 722, and photo-interrupter (not shown) are fixed on a base plate 721 (a frame) of the aforementioned bin turning device 720. Worm gear G21 fixed to a main shaft of DC motor M5 rotates gear G24 clockwise fixed to a drive shaft 723, through worm wheel G22 and intermediate gear G23 which are rotatably provided to an intermediate shaft 722.

The first arm 724 is fixed to the lower portion of the drive shaft 723 which is integrated with the aforementioned gear G24, and pushed counterclockwise by a torsion spring 725. The second arm 726 is provided on the lower side of the first arm 724 in such a manner that the second arm 726 can be slid in a radial direction (in a direction of a normal line of the arm). To be more specific, two slots 726A, 726B are formed in the second arm 726, and a lower end portion of the drive shaft 723 is slidably contacted with the slot 726A, located close to the center of rotation, and a protrusion 724A protruded to a lower side of the first arm is slidably contacted with the slot 726B. The lowermost portions of the drive shaft 723 and the protrusion 724A are screwed to the base plate through a washer while the second arm 726 is movably supported.

A fixing pin 72A is mounted on the left end of the second arm 726 as shown in FIG. 24, and a roller 72 composed of a rotatable ring 72B and a rubber ring 72C coating the peripheral surface of the ring 72B, is rotatably provided to the fixing pin 72A.

A pin 727 is protruded downward from an intermediate portion of the second arm 726, and rotatably engaged with a roller 728.

A cam plate 729 is provided in a lower portion of the base plate 721. A cam slot 729A, the shape of which is a reverse S, is formed in the cam plate 729 as shown in FIG. 23. As shown in FIG. 23, the cam slot 729A comprises: an equal radius arcuate cam section (1)–(2), the radial center of which is the drive shaft 723; a cam section (2)–(3), the curve of which is formed so that the rotation radius is gently decreased; and a cam section (3)–(4) the curve of which is formed so that the rotation radius is gently increased. A roller 728 provided to the second arm 726 is rotatably contacted with the cam slot 729A so that the roller 728 can be moved along the inner wall surface of the cam slot 729A, and the locus of the roller 728 is formed in accordance with the curve of the cam slot.

Figure 26:
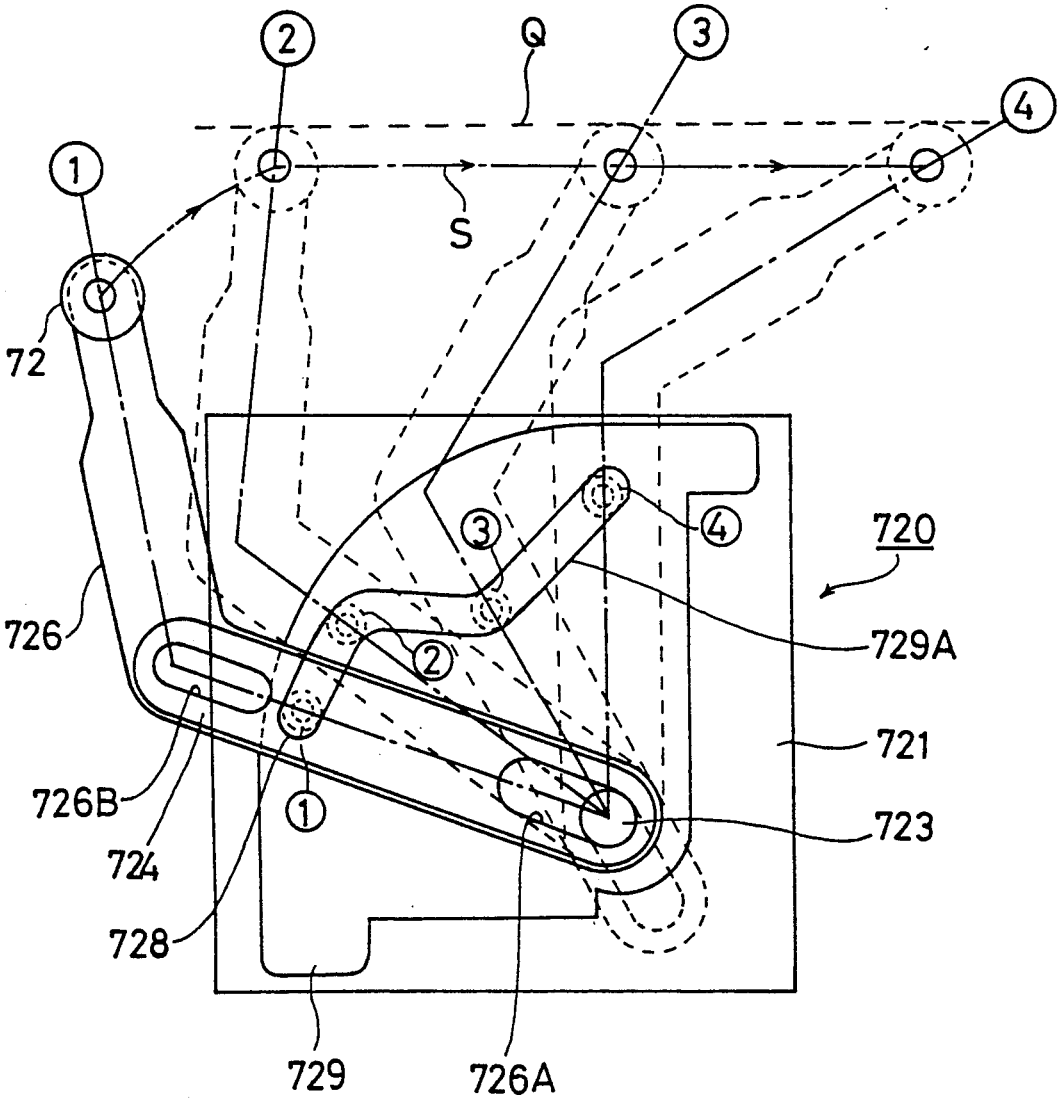
FIG. 26 is a plan view showing oscillating progress of the arm of the bin oscillating device.

FIG. 26 is a plan view of the bin turning device 720, which shows the turning process of the second arm 726. In this case, the first arm 724 and the second arm 726 shown in FIGS. 23, 24, 25 and 26 are illustrated by a solid line in a starting operation, and illustrated by a broken line in the turning operation.

When the operations of the arms 724, 726 are started by the bin turning device 720, the first arm 724 pivotally supported by the drive shaft 703 is pushed counterclockwise by the torsion spring 725, and contacted with the left end of the cam slot 729A so as to be stopped, which is shown by (1) in FIG. 26.

When motor M5 is driven in the aforementioned state, the drive shaft 723 is normally rotated through the gear train system including G21, G22, G23, G24, so that the first arm 724 is rotated clockwise. At the same time, the second arm 726 slidably supported by the first arm 724 is integrally rotated clockwise, and the roller 72 mounted on the tip of the second arm 726 pushes the stopping surface of the bin 41 so that the bin 41 is turned toward a stapling position as described in the first and second embodiments.

The shape of the curved surface of the cam slot 729A is formed as follows: portions (1) and (2) shown in FIG. 26 are formed to be an equal radius, the center of which is the drive shaft 723. Consequently, in a process in which the second arm 726 is rotated from state (1) to state (2), the first arm 724 and the second arm 726 are rotated around the drive shaft 723. Accordingly, the roller portion 72 mounted on the tip of the second arm 726 is moved clockwise around the drive shaft 723 along an arcuate locus R, the radius of which is equal.

Further, when the first arm 724 is rotated and the second arm 726 follows the first arm 724, the roller 728 engaged with the pin 727 provided in a predetermined position of the second arm 726 is moved along the curved portions (2)–(3) of the slot cam 729A. As the roller 728 is moved in the aforementioned manner, the second arm 726 formed integrally with the roller 728 is moved in the radial direction being restricted by the drive shaft 723 and the protrusion 724A coming into contact with the slots 726A, 726B. Accordingly, the radius of rotation is reduced, so that the center of the roller 72 mounted on the tip of the second arm 726 deviates from the aforementioned circular locus R and the roller 72 advances along an approximately straight locus S illustrated by a one-dotted chain line shown in FIGS. 23 and 26. (2)–(3)

When the first arm 724 is further rotated, the roller 728 is moved along the curve represented by (3)–(4) of the cam slot 729A. Accordingly, the roller 72 mounted on the tip of the second arm 726 successively advances along an approximately linear locus S. (3)–(4)

The shape of the curve of the cam slot 729A determines the locus of the roller 72. Accordingly, the shape of the curve of the cam slot 729A is determined in accordance with the shape and size of the first and second arms 724 and 726. In the aforementioned embodiment, the locus (2)–(3)–(4) of the roller 72 is set to be approximately linear. However, the cam slot 729A can be designed, selecting an appropriate locus in accordance with the turning state of the bin 41 contacted with the roller 72.

Figure 27:
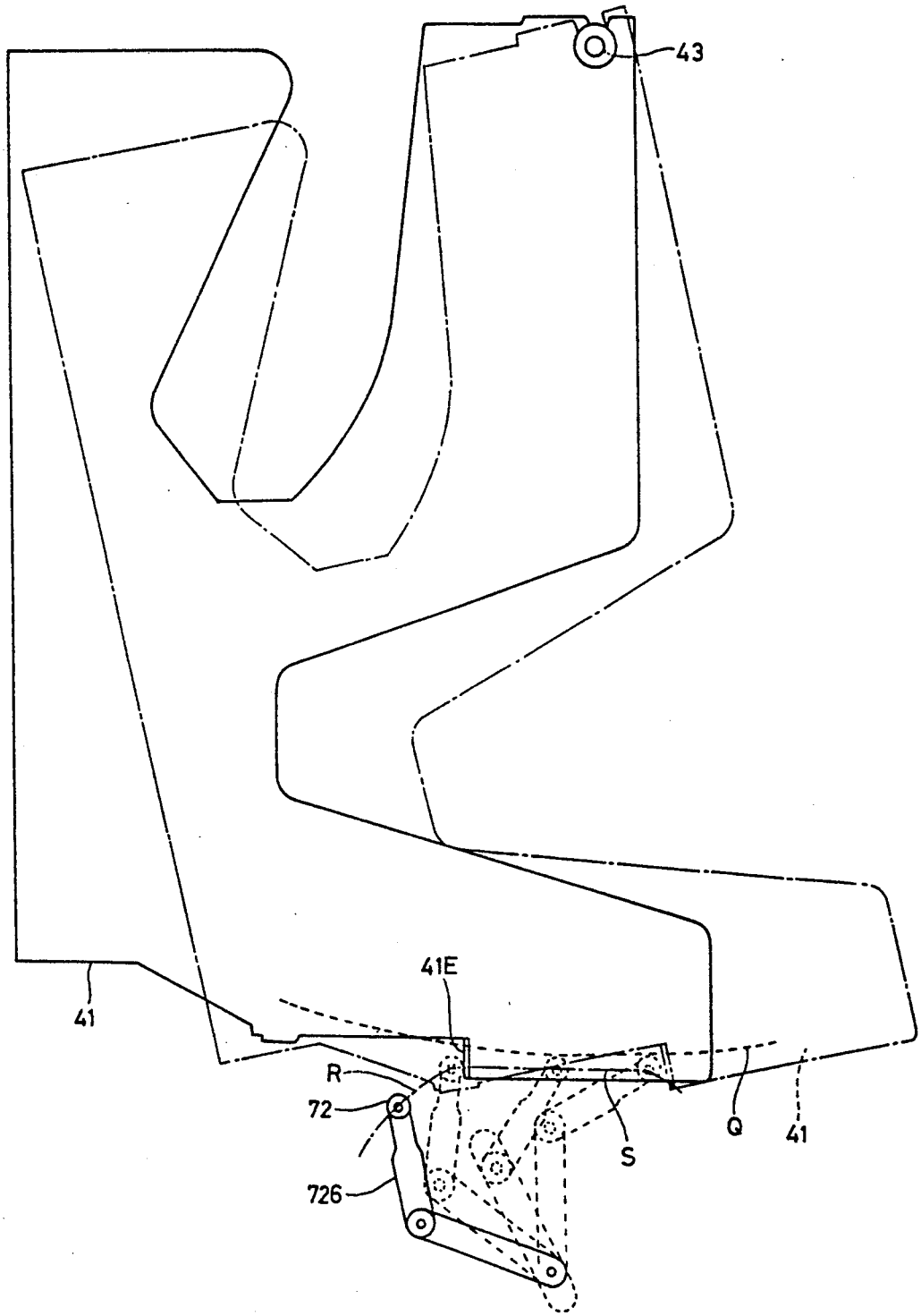
FIG. 27 is a plan view showing oscillating progress of the arm and bin.

FIG. 27 is a plan view showing a turning progress of the bin 41 caused by the rotation of the arm 726. When the second arm 726 is rotated, the roller 72 is moved along circular locus R and comes into contact with the stopping surface 41E of the bin 41. Then, the roller 72 moves to the right along approximately linear locus S, and pushes the stopping surface 41E, so that the bin 41 is turned around the fixed shaft 43. When the bin 41 is moved in the aforementioned manner, the stopping surface 41E is turned around the fixed shaft 43 along circular arc Q. On the other hand, the roller 72 is moved along locus S which is approximate to the aforementioned circular locus Q being located in parallel. Consequently, the roller 72 rotates the bin 41, being moved along locus S which is approximate to locus Q, so that locking is not caused.

As explained above, according to the present invention, in a sorter provided with a moving bin type stapler, a malfunction such as locking of the bin turning device and unevenness of bin rotation can be solved when the bin rotating arm is made into a double structure having a spring action. Due to the foregoing, the bin can be smoothly and stably moved to a stapling position.

The bin turning device can be rotated by a low torque type of motor, so that electric power can be saved and the cost can be effectively reduced.

Further, when the locus of the roller to drive the bin is determined by the cam mechanism of the bin turning device, made to become approximate to the locus of the bin stopping surface, the locking of the bin turning device to the bin can be prevented. The restricting means to restrict the motion of the arm are provided on the bin turning device side, so that deformation of the bin and lever, and a malfunction of the paper pressing mechanism relating to the deformation can be prevented.

What is claimed is:

1. A sorting and stapling apparatus, comprising:
a plurality of plate-shaped bins;
a plurality of guide members provided for said plurality of bins so that each of said plurality of bins is respectively slidable on a respective one of said plurality of guide members, between a first position and a second position;
each of said plurality of bins receiving and stacking sheets at said first position;
stapling means positioned at said second position of said plurality of bins for stapling the thus stacked sheets;
moving means for respectively moving each of said plurality of bins from said first position to said second position; and
a plurality of spring members provided for said plurality of bins, each spring member returning a respective one of said plurality of bins from said second position to said first position.

2. The apparatus of claim 1, further comprising a vertically fixed shaft having an axial and wherein
said plurality of bins are respectively rotatably mounted in tandem, at regular intervals, on said vertically fixed shaft so that each of said bins is respectively rotatable between said first and said second positions.

3. The apparatus of claim 2, further comprising a plurality of slidable holding members mounted in tandem at said regular intervals on said vertically fixed shaft, for rotatably holding said bins.

4. The apparatus of claim 3, wherein:
an edge portion of each of said plurality of bins comprises a cut-out portion in a shape of a U; and
each of said plurality of slidable holding members is shaped to be engageable with a respective one of said U-shaped cut-out portions.

5. The apparatus of claim 4, wherein each of said plurality of slidable holding members includes stop means for closing said respective one of said U-shaped cut-out portions.

6. The apparatus of claim 4, wherein said plurality of slidable holding members holds said plurality of bins at an angle relative to a horizontal plane.

7. The apparatus of claim 2, further comprising a plurality of supporting means for respectively rotatably supporting each of said plurality of bins when said moving means moves said bins from said first position to said second position.

8. The apparatus of claim 7, wherein each of said plurality of supporting means respectively is in slidable contact with a bottom portion of a respective one of said plurality of bins.

9. The apparatus of claim 8, wherein each of said plurality of supporting means includes a cut-out portion on a bottom portion of each of said plurality of bins; and further comprising:
a respective claw member engageable with said cut-out portion of each of said plurality of bins.

10. The apparatus of claim 2, further comprising roller means for respectively supporting each of said plurality of bins such that each of said plurality of bins is respectively supported by said roller means during the movement of each of said plurality of bins by the moving means from said first position to said second position.

11. The apparatus of claim 10, further comprising a plurality of supporting means for respectively supporting each of said plurality of bins such that each of said bins is respectively supported by at least one supporting means in addition to said roller means.

12. The apparatus of claim 2, wherein said moving means includes rotation means, said rotation means comprising:

a plurality of pushing members for respectively pushing each of said plurality of bins in a direction to rotate each of said bins around said shaft from said first position to said second position; and said plurality of spring members for respectively returning each of said plurality of bins from said second position to said first position.

13. The apparatus of claim 12, wherein each of said plurality of pushing members comprises:

a drive member;

a first rotatable arm member coupled to said drive member, said first rotatable arm member being mounted to be rotatable around a rotation axis thereof by said drive member;

a second arm member mounted on said first rotatable arm member; and said second arm member being slidably mounted on said first rotatable arm member in a radial direction of said first rotatable arm member.

14. The apparatus of claim 13, wherein said drive member includes a cam for rotating said first arm member.

15. The apparatus of claim 13, wherein each of said plurality of pushing members further comprises a spring member for biasing said second arm member in said radial direction of said first rotatable arm member.

16. The apparatus of claim 13, wherein said second arm member includes a roller disposed at a tip end portion of said second arm member for contacting a respective one of said bins to be pushed by said pushing member.

17. The apparatus of claim 12, wherein each of said plurality of pushing members comprises:

a drive member;

a first rotatable arm member coupled to said drive member, said first rotatable arm member being mounted to be rotatable around a rotation axis thereof, by said drive member;

a second arm member rotatably mounted at a free end portion of said first rotatable arm member; and a spring for biasing said second arm member in a rotation direction of said second arm member.

18. The apparatus of claim 12, wherein each of said plurality of pushing members comprises:

a drive member;

a first rotatable arm member coupled to said drive member, said first rotatable arm member being mounted to be rotatable around a rotation axis thereof by said drive member;

a second arm member slidably mounted on said first rotatable arm member;

a cam follower fixed on said second arm member for sliding said second arm member in a radial direction of said first rotatable arm member; and a cam having a curved cam surface for regulating a position of said cam follower.

19. The apparatus of claim 18, further comprising:

a roller mounted at a tip end portion of said second arm member;

said roller contacting a respective one of said plurality of bins; and said roller moving along a locus defined by a movement of a position of said cam follower.

20. The apparatus of claim 19, further comprising regulating means for regulating a movement of said roller along the locus, such that the locus of movement is a substantially straight line.

21. A sorting and stapling apparatus comprising:

a vertically fixed shaft;

a plurality of plate shaped bins for receiving and stacking sheets thereon, said plurality of bins being rotatably attached in tandem, at regular intervals, to said vertically fixed shaft so that each of said bins is rotatable about said vertically fixed shaft between a first and a second position, each of said bins receiving and stacking sheets when positioned at said first position;

a stapler for stapling the thus stacked sheets, said stapler being positioned at said second position;

a plurality of rotation means for respectively rotating each of said bins between said first and said second positions;

each of said rotation means including:

a pushing member for respectively pushing a respective one of said plurality of bins in a direction to rotate said respective one of said plurality of bins around said shaft from said first position to said second position; and a spring member for returning said respective one of said plurality of bins from said second position to said first position; and said pushing member including:

a drive member;

a first rotatable arm member coupled to said drive member, said first rotatable arm member being mounted to be rotatable around a rotation axis thereof by said drive member;

a second arm member mounted on said first rotatable arm member; and said second arm member being mounted slidably in a radial direction of said first rotatable arm member.

22. The apparatus of claim 21, wherein the second arm member is mounted at a free-end portion of the first rotatable arm member.

23. The apparatus of claim 21 wherein each of said pushing members further includes:

means for slidably mounting the second arm member on said first arm member;

a cam follower fixed on said second arm member for sliding said second arm member in a radial direction of said first rotatable arm member; and a cam having a curved cam surface for regulating a position of said cam follower.

24. The apparatus of claim 23, further comprising:

a roller mounted at a tip end portion of said second arm member;

said roller contacting a respective one of said plurality of bins; and said roller moving along a locus defined by a movement of a position of said cam follower.

25. The apparatus of claim 24, further comprising regulating means for regulating a movement of said roller along the locus, such that the locus of movement is a substantially straight line.

* * * * *